US005970947A

United States Patent [19]

Iida et al.

[11] Patent Number: 5,970,947

[45] Date of Patent: Oct. 26, 1999

[54] CONTROL APPARATUS FOR A CYLINDER-INJECTION SPARK-IGNITION INTERNAL COMBUSTION ENGINE

[75] Inventors: Kazumasa Iida, Kyoto; Katsuhiko Miyamoto, Funai-gun, both of Japan

[73] Assignee: Mitsubishi Jidosha Kogyo Kabushiki Kabushiki Kaisha, Tokyo, Japan

[21] Appl. No.: 08/917,493

[22] Filed: Aug. 26, 1997

[30] Foreign Application Priority Data

Aug. 27, 1996 [JP] Japan ..... 8-225721

[51] Int. Cl.[6] ..... F02B 17/00

[52] U.S. Cl. ..... 123/295; 123/305; 123/492; 123/406.45

[58] Field of Search ..... 123/295, 305, 123/492, 406.51, 406.45, 406.46

[56] References Cited

U.S. PATENT DOCUMENTS

| | | | |
|---|---|---|---|
| 5,797,363 | 8/1998 | Iida et al. | 123/295 |
| 5,803,048 | 9/1998 | Yano et al. | 123/443 |
| 5,819,701 | 10/1998 | Morikawa | 123/305 |
| 5,826,559 | 10/1998 | Ichimoto et al. | 123/295 |
| 5,832,893 | 11/1998 | Kamura et al. | 123/305 |

FOREIGN PATENT DOCUMENTS 63-12850A 1/1988 Japan .

5-99020A 4/1993 Japan .

*Primary Examiner*—Willis R. Wolfe
*Assistant Examiner*—Mahmoud M. Gimie

[57] ABSTRACT

A control apparatus for a cylinder-injection engine includes an electronic control unit which calculates an average effective pressure according to throttle opening and engine rotation speed, calculates an intake air amount per intake stroke according to an intake air amount detected by an airflow sensor and engine rotation speed, and calculates a volumetric efficiency based on the calculated intake air amount. A fuel injection amount is calculated according to an intake air amount and a target air-fuel ratio calculated based on a target average effective pressure when a compression-stroke injection mode is selected, and according to the intake air amount and a target air-fuel ratio calculated based on the volumetric efficiency when an intake-stroke injection mode is selected, whereby a fuel injection control is made based on the target air-fuel ratio suited to the injection mode, while managing the target air-fuel ratio, thereby always ensuring a proper combustion control and a stabilized engine operating state. During the changeover of injection mode, the target air-fuel ratio, determined for an injection mode before the changeover, is changed, at a speed which changes stepwise, to that determined for an injection mode after the changeover, whereby an engine torque change caused by a sudden change in fuel injection amount is suppressed to a minimum, thereby reducing a torque shock.

20 Claims, 15 Drawing Sheets

CONTROL APPARATUS FOR A CYLINDER-INJECTION SPARK-IGNITION INTERNAL COMBUSTION ENGINE

BACKGROUND OF THE INVENTION

1. Field of the Invention

This invention relates to a cylinder-injection spark-ignition internal combustion engine, and more particularly, to a control apparatus for controlling an automotive internal combustion engine of this kind.

2. Related Art

In a spark-ignition internal combustion engine mounted on a vehicle, various types of cylinder-injection gasoline engines, in which fuel is directly injected into a combustion chamber, have been recently proposed to reduce emission of harmful exhaust gas components and improve the fuel efficiency, instead of a conventional manifold-injection engine, in which fuel is injected into an intake pipe.

A cylinder-injection gasoline engine is arranged to inject fuel from a fuel injector into a cavity formed at a top face of a piston, to thereby supply an air-fuel mixture having an approximate stoichiometric air-fuel ratio around a spark plug at the time of ignition, whereby ignition is enabled even if a mixture as seen in the entirety of a cylinder has a lean air-fuel ratio, so that the emission of CO and HC is reduced and the fuel efficiency at the time of idle operation or low load traveling is largely improved.

In such a gasoline engine, a shift is made between a compression-stroke injection mode (second-term injection mode) and an intake-stroke injection mode (first-term injection mode) in dependence on engine operating condition or engine load. More specifically, at the time of low load operation, fuel is injected in the compression stroke so that an air-fuel mixture having an approximate stoichiometric air-fuel ratio is formed around the spark plug or in the cavity, thereby enabling excellent ignition with a mixture whose air-fuel ratio is as a whole lean. On the other hand, at the time of medium or high load operation, fuel is injected in the intake stroke so that a mixture whose air-fuel ratio is uniform in the combustion chamber is supplied, whereby a large amount of fuel is burnt to produce an engine output required at the time of acceleration or high speed traveling, as in the case of a conventional manifold-injection type gasoline engine.

Japanese Unexamined Patent Publication No. 5-99020 discloses, at the introduction part of the specification, a 2-cycle cylinder-injection internal combustion engine, as a prior art, in which a fuel injection amount at the time of low load operation is calculated depending on a throttle valve opening and engine rotation speed and in which a fuel injection amount at the time of engine high load operation is calculated depending on intake air amount detected by an air flow meter and engine rotation speed. In this internal combustion engine, when the throttle valve opening is changed, not only the fuel injection amount is calculated and adjusted, but also the intake air amount supplied into the cylinder is adjusted. For the intake air amount adjustment, the opening degree of an air control valve is controlled, which valve is provided in a bypass line, bypassing a mechanical supercharger disposed in the intake pipe of the engine.

In this 2-cycle cylinder-injection engine, a delay occurs between when the throttle valve opening is changed and when the intake air amount supplied to the cylinder reaches a required amount, which is determined by the changed throttle valve opening and the engine rotation speed. On the other hand, the cylinder-injection internal combustion engine can supply, without a delay, the cylinder with fuel in the same amount as a calculated fuel injection amount when the calculated amount changes with a change in the throttle valve opening, as distinct from the internal combustion engine, in which fuel is injected into the intake pipe. In this regard, the aforementioned 2-cycle engine entails a problem that an actual air-fuel ratio is deviated from an optimum air-fuel ratio until the intake air amount supplied to the cylinder reaches a required amount determined by the changed throttle valve opening and the engine rotation speed.

To eliminate such a problem, the aforesaid Japanese Patent Publication proposes a technical art, in which, at the time of calculating the fuel injection amount based on throttle valve opening, a response of a fuel injection amount change to a change in throttle valve opening is retarded than a response, at the time of fuel injection amount calculation based on intake air amount, of a change in the fuel injection amount to a change in the intake air amount. More specifically, a filtering quantity for the throttle-valve-opening-based control is set to be larger than that for the intake-air-amount-based control.

In detail, according to the technical art described in the above Japanese Patent Publication, in addition to the air control valve provided in a bypass line, bypassing a mechanical supercharger disposed in the intake air pipe at a location downstream of the throttle valve, an air bypass valve is provided in another bypass line, which bypasses the throttle valve. To eliminate the problem that an optimum intake air corresponding to the fuel injection amount cannot be supplied to the cylinder, even if the intake air amount is controlled by the throttle valve, at the time of low-load operation in which the fuel injection amount increases with an increase of the accelerator pedal depressing amount, the openings of the air control valve and the air bypass valve are adjusted in the throttle-valve-opening-based fuel injection amount control to obtain an optimum intake air amount suited to the fuel injection amount and prevent an occurrence of a large difference between pressures at locations upstream and downstream of the supercharger to thereby suppress a driving loss of the mechanical supercharger. As a consequence, an amount of air returned to the upstream of the mechanical supercharger through the bypass lines is adjusted. Further, a filtering quantity is increased in the throttle-valve-opening-based fuel injection amount control, to thereby eliminate a delay in response in the air amount adjustment.

However, no clear relation is found between the fuel injection amount and the intake air amount in case that a control of the fuel injection amount is made while adjusting intake air amount, as in the case disclosed in the Japanese Patent Publication. For this reason, it is difficult to obtain an intake air amount suited to the fuel injection amount, so that a sufficient engine output cannot be obtained or a combustion state can be worsened. If a deteriorated combustion state is left, resultant harmful gases are discharged from the engine to the atmosphere, and a deterioration of the engine is caused.

In a typical cylinder-injection gasoline engine, a shift is made between a first- and second-term injection modes in dependence on engine load, as described above. In the first-term injection mode, the air-fuel ratio cannot be made too lean, and hence the air-fuel ratio is set to a value of about 20 or less. On the other hand, in the second-term injection mode where the fuel is injected in a latter stage of the compression stroke, the degree of stratification of an air-fuel mixture is high and an approximate stoichiometric air-fuel mixture is formed locally around the spark plug. If the air-fuel ratio is adjusted to a value on an excessively fuel-rich side, then a misfire may be caused in the engine. Usually, therefore, the air-fuel ratio is set to a value of about 22 or more. As a result, an air-fuel ratio range in which combustion is disabled is present between the air-fuel ratio of 20 and 22.

The combustion-disabled range is inevitably passed when a changeover is made between the first- and second-term injection modes. In the combustion-disabled range, the operating state of the engine is worsened and the engine output torque temporarily decreases or increases. If even a temporal increase or decrease in the engine output torque occurs at the time of mode changeover, an undesired torque shock is caused.

Japanese Unexamined Patent Publication No. 63-12850 states that, in case that a target air-fuel ratio for a conventional manifold-injection engine is changed in accordance with intake pipe pressure, a change rate of engine rotation speed (or change rate of vehicle speed), and throttle opening, if the same changeover speed is used between when the target ratio is switched from the stoichiometric air-fuel ratio to a lean air-fuel ratio and when the target ratio is switched from a lean air-fuel ratio to the stoichiometric air-fuel ratio, an undesired large shock occurs or an amount of NOx emission increases at the time of changeover of the target air-fuel ratio. To obviate this, the technical art disclosed in the just-mentioned Japanese Patent Publication causes the changeover speed, at the time of changeover to a lean air-fuel ratio, to be lowered to give a high priority to a reduction of shock in view of the fact that a large shock occurs and a NOx emission level is high when a shift is made from the stoichiometric air-fuel ratio to a lean air-fuel ratio. On the other hand, when a lean air-fuel ratio is switched to the stoichiometric air-fuel ratio, the changeover speed is increased to give a high priority to a reduction of NOx emission in view of the fact that a shock is relatively small and the NOx emission level is low and gradually decreases with an increase in the changeover speed.

However, it is difficult to apply the technical art, described in the above Japanese Patent Publication and constructed to meet a manifold-injection engine, to a cylinder-injection engine, in which fuel injection timing is changed upon changeover of injection mode and in which the air-fuel ratio passes through a combustion-disabled range. Moreover, even if the technical art is applicable to an cylinder-injection engine, it is impossible to ensure an appropriate combustion state and reduce a torque shock in a cylinder-injection engine, which is entirely different in engine characteristics and in control method from the intake-manifold injection engine.

SUMMARY OF THE INVENTION

An object of the present invention is to provide a control apparatus for a cylinder-injection spark-ignition internal combustion engine, which apparatus is capable of always maintaining an appropriate combustion state and a stabilized engine operating state in which no substantial torque shock is caused upon changeover of injection mode.

According to one aspect of the present invention, there is provided a control apparatus for a cylinder-injection internal combustion engine having a combustion chamber, a fuel injection device for supplying fuel directly into the combustion chamber, and an accelerator member for engine speed adjustment. The control apparatus comprises: acceleration state detecting means for detecting an operation state of the accelerator member and generating an output indicative of the detected operation state of the accelerator member; intake air amount detecting means for detecting an intake air amount sucked into the combustion chamber and generating an output indicative of the detected intake air amount; first load-related value calculating means for calculating a first load-related value in accordance with the output of the acceleration state detecting means; second load-related value calculating means for calculating a second load-related value in accordance with the output of the intake air amount detecting means; injection mode selecting means for selecting either a compression-stroke injection mode where fuel injection is performed mainly in a compression stroke or an intake-stroke injection mode where fuel injection is performed mainly in an intake stroke, in accordance with either the first or second load-related value; target air-fuel ratio calculating means for calculating a target air-fuel ratio based on each of the first and second load-related values; fuel injection amount calculating means for calculating a fuel injection amount in accordance with the target air-fuel ratio calculated based on the first load-related value by the target air-fuel calculating means and the intake air amount detected by the intake air amount detecting means when the compression-stroke injection mode is selected by the injection mode selecting means, and for calculating a fuel injection amount in accordance with the target air-fuel ratio calculated based on the second load-related value by the target air-fuel ratio calculating means and the intake air amount detected by the intake air amount detecting means when the intake-stroke injection mode is selected; and a fuel injection control means for controlling the fuel injection device in accordance with the fuel injection amount calculated by the fuel injection amount calculating means.

According to the present invention, a target air-fuel ratio suited to a selected injection mode can be obtained by calculating the first load-related value based on the operating state of the accelerator member, which appropriately reflects the engine operating state in the compression-stroke injection mode, by calculating the second load-related value based on the intake air amount, which appropriately reflects the engine operating state in the intake-stroke injection mode, and by calculating a target air-fuel ratio in accordance with an associated one load-related value which corresponds to the selected injection mode. A high correlation is found between the first load-related value calculated based on the operating state of the accelerator member and the engine operating state in the compression-stroke injection mode, and between the second load-related value calculated based on the intake air amount and the engine operating state in the intake-stroke injection mode. Thus, the target air-fuel ratio calculated based on either one, having a higher correlation to the injection mode, of the first and second load-related values is suited to the injection mode. By using a fuel injection amount calculated in accordance with the thus calculated target air-fuel ratio and the intake air amount, a fuel injection control suited to the injection mode can be carried out, while always managing the target air-fuel ratio. As a result, a stabilized combustion in the internal combustion engine can be made, to thereby maintain a proper engine operating state.

Preferably, the control apparatus further comprises intake air amount correcting means for correcting the intake air amount detected by the intake air amount detecting means when the intake-stroke injection mode is selected by the injection mode selecting means.

With this preferred control apparatus, it is possible to prevent a deteriorated engine operating state caused by an unnecessary intake air correction in the compression-stroke injection mode where the suction of intake air is completed prior to the injection of fuel, without a delay, and hence the amount of fuel injection can be set appropriately in accordance with the detected intake air amount. Meanwhile, a proper fuel injection amount can be set in the intake-stroke injection mode, which entails a delay in sucking intake air, by correcting the detected intake air amount.

Preferably, the target air-fuel ratio calculating means sets the target air-fuel ratio to a first air-fuel ratio, which is leaner than the stoichiometric air-fuel ratio, when the compression-stroke injection mode is selected by the injection mode selecting means. When the intake-stroke injection mode is selected, the target air-fuel ratio calculating means sets the target air-fuel ratio to a second air-fuel ratio, which is richer than the first air-fuel ratio.

With this preferred arrangement, a lean air-fuel ratio operation of the engine can be carried out stably in the compression-stroke injection mode, thereby improving the fuel-efficiency, whereas the engine output can be increased by operating the engine in the intake-stroke injection mode.

Preferably, the control apparatus further comprises air-fuel ratio transition means for variably setting a transitional target air-fuel ratio when an injection mode, different from an injection mode then selected, is newly selected by the injection mode selecting means so that an injection mode changeover is commenced. The air-fuel ratio transition means sets a mode-changeover air-fuel ratio, which falls within a range defined by a target air-fuel ratio in the injection mode before the changeover and a target air-fuel ratio in the injection mode after the changeover, and gradually changes the transitional target air-fuel ratio at a first change speed from the target air-fuel ratio in the injection mode before the changeover to the mode-changeover air-fuel ratio, while maintaining a fuel injection timing suitable for the injection mode before the changeover. When the transitional target air-fuel ratio reaches the mode-changeover air-fuel ratio, the air-fuel ratio transition means changes the fuel injection timing suitable for the injection mode before the changeover to a fuel injection timing suitable for the injection mode after the changeover and gradually changes the target air-fuel ratio at a second change speed from the mode-changeover air-fuel ratio or an air-fuel ratio in the vicinity thereof to the target air-fuel ratio in the injection mode after the changeover.

According to this preferred apparatus, it is possible to suppress, with use of a relatively simplified control arrangement, a change in the engine output torque caused by a sudden change in the fuel injection amount upon changeover of injection mode.

Preferably, the air-fuel ratio transition means sets the second change speed to a value smaller than the first change speed. In this case, a torque shock after the changeover of injection mode can be reduced appropriately.

Preferably, when a changeover is made from the intake-stroke injection mode to the compression-stroke injection mode, the air-fuel ratio transition means sets the second change speed to a value smaller than the first change speed. With this arrangement, it is possible to suppress a large torque shock, which is likely to occur in the engine when a changeover is made from the intake-stroke injection mode to the compression-stroke injection mode, which changeover generally takes place at the start of a decelerating engine operation caused by a change in engine operating state from a medium/high load range to a low load range. Thus, the control apparatus makes it possible to improve the drivability of a vehicle on which the internal combustion engine is mounted.

Preferably, the air-fuel ratio transition means sets the first and second change speeds in accordance with the first load-related value. In this case, the first and second change speeds can be set appropriately in dependence on the first load-related value which properly reflects the engine operating state, to thereby prevent a change in engine output torque upon changeover of the injection mode.

Preferably, the air-fuel ratio transition means sets the first and second change speeds in dependence on a quantity of intake air amount adjustment, which is effected by intake air amount adjusting means provided in the internal combustion engine, for adjusting the intake air amount in accordance with the output from the acceleration state detecting means. In this case, the first and second change speeds can be set to follow a control for increasing or decreasing the intake air amount, so that the fuel injection amount can be changed depending on the increasingly or decreasingly controlled intake air amount. As a result, it is possible to adequately prevent a change in the engine output torque upon changeover of the injection mode.

According to another aspect of the present invention, there is provided a control apparatus for a cylinder-injection internal combustion engine having a combustion chamber and a fuel injection device for supplying fuel directly to the combustion chamber. The control apparatus comprises: operating state detecting means for detecting an operating state of the internal combustion engine; injection mode selecting means for selecting either a compression-stroke injection mode where fuel injection is performed mainly in a compression stroke or an intake-stroke injection mode where fuel injection is performed mainly in an intake stroke, in accordance with the operating state of the internal combustion engine detected by the operating state detecting means; combustion parameter setting means for setting a value of a combustion parameter, affecting a combustion state in the combustion chamber, in dependence on the injection mode selected by the injection mode selecting means; combustion control means for controlling the combustion state in accordance with the combustion parameter value set by the combustion parameter setting means and corresponding to the selected injection mode; and combustion parameter transition means for changing a combustion parameter value before the changeover, suitable for the injection mode before the changeover, to a combustion parameter value after the changeover, suitable for the injection mode after the changeover, when an injection mode, different from an injection mode then selected, is newly selected by the injection mode selecting means so that an injection mode changeover is commenced. The combustion parameter includes a target air-fuel ratio. The combustion parameter transition means includes air-fuel ratio transition means for variably setting a transitional target air-fuel ratio when the injection mode changeover is performed. The air-fuel ratio transition means sets a mode-changeover air-fuel ratio, which falls within a range defined by a target air-fuel ratio in the injection mode before the changeover and a target air-fuel ratio in the injection mode after the changeover, and gradually changes the transitional target air-fuel ratio at a first change speed from the target air-fuel ratio in the injection mode before the changeover to the mode-changeover air-fuel ratio, while maintaining a fuel injection timing suitable for the injection mode before the changeover. When the target air-fuel ratio reaches the mode-changeover air-fuel ratio, the air-fuel ratio transition means changes the fuel injection timing suitable for the injection mode before the changeover to a fuel injection timing suitable for the injection mode after the changeover and gradually changes the transitional target air-fuel ratio at a second change speed from the mode-changeover air-fuel ratio or an air-fuel ratio in the vicinity thereof to a target air-fuel ratio in the injection mode after the changeover.

The control apparatus according to the second aspect of the present invention is advantageous in that it is possible to suppress a change in the engine output torque caused by a sudden change in the fuel injection amount upon changeover of the injection mode.

As in the case of the control apparatus according to the first aspect of the present invention, preferably, the second change speed is set to a value smaller than the first change speed, to thereby reduce a torque shock caused by a changeover of the injection mode. More preferably, the second change speed is set to a value smaller than the first change speed upon changeover from the intake-stroke injection mode to the compression-stroke injection mode. Further, the first and second change speeds may be set depending on a quantity of intake air amount adjustment effected by intake air amount adjusting means. Further, the first and second change speeds may be set based on the first load-related value calculated in accordance with an operation state of an accelerator member for engine speed adjustment.

Preferably, the control apparatus further comprises intake air amount detecting means for detecting an intake air amount sucked into the combustion chamber. The air-fuel ratio transition means sets the first and second change speeds to be proportional to a quantity of change in intake air amount detected by the intake air amount detecting means. In this case, the fuel injection amount can be changed to coincide to a change in intake air amount, thereby suppressing a change in the engine output torque.

Preferably, the combustion parameter includes an ignition timing at which fuel supplied from the fuel injection device to the combustion chamber is spark-ignited by ignition means provided in the internal combustion engine. The combustion parameter transition means includes ignition timing transition means for controlling a transitional ignition timing, serving as the ignition timing during injection mode transition, to allow the output of the internal combustion engine to change smoothly, when the injection mode transition is made. In this case, the ignition timing upon transition of the injection mode can be optimized, to thereby maintain a proper combustion state in the engine.

DETAILED DESCRIPTION

With reference to the accompanying drawings, a control apparatus, according to an embodiment of the present invention, for a cylinder-injection spark-ignition engine which is mounted on a vehicle will be described.

Figure 1:
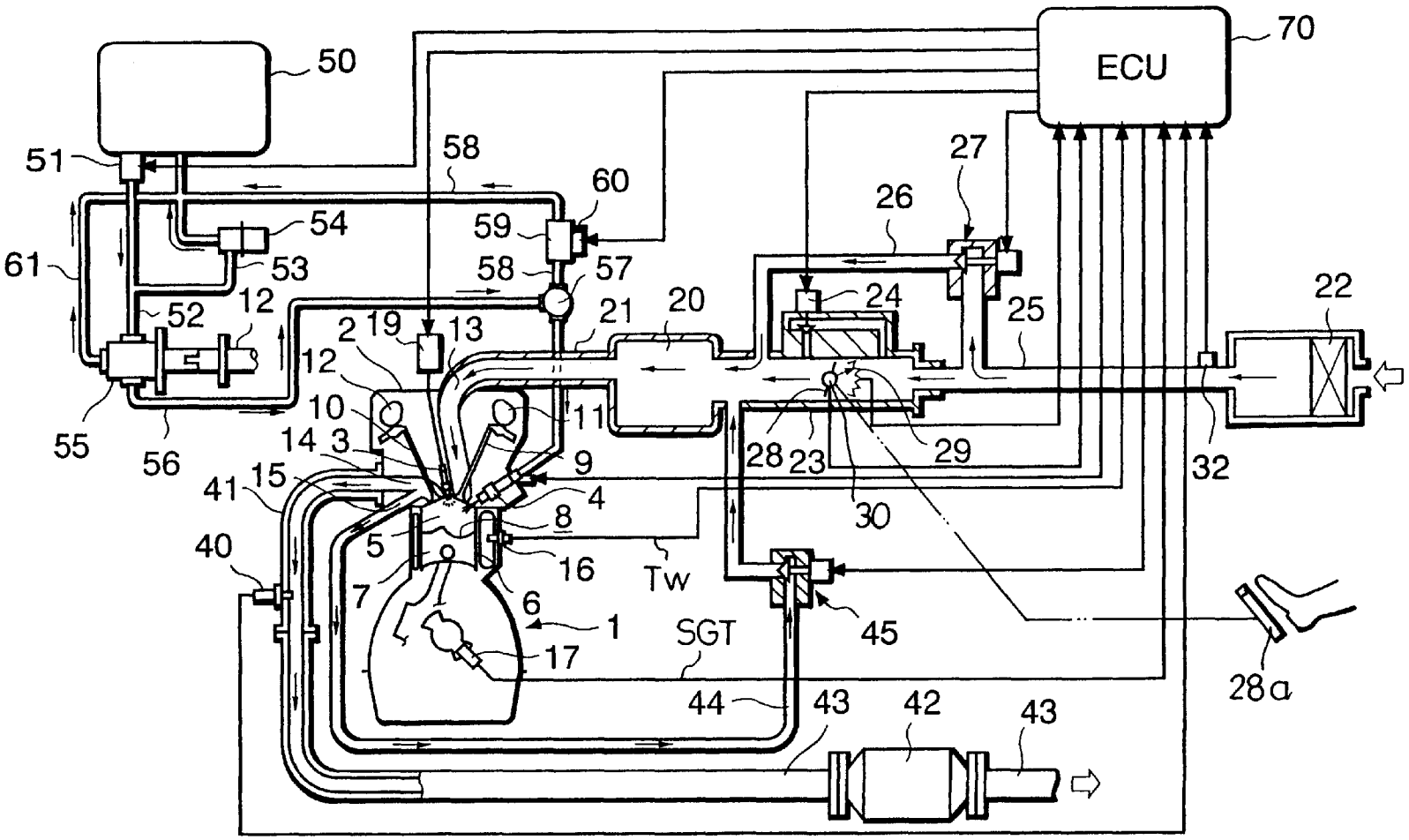
FIG. 1 is a schematic diagram showing a control apparatus according to an embodiment of the present invention, together with a cylinder-injection gasoline engine provided therewith.

Referring to FIG. 1, reference numeral 1 denotes a straight type cylinder-injection four-cylindered gasoline engine, which is designed to carry out fuel injection in the compression stroke (second-term injection mode) and in the intake stroke (first-term injection mode) and permit combustion under a lean air-fuel ratio. The cylinder-injection engine 1 has combustion chambers, intake system, exhaust gas recirculation system (EGR) and the like, which are designed exclusively for cylinder injection, to thereby achieve a stable engine operation under rich air-fuel ratio, stoichiometric air-fuel ratio (stoichiometric air-fuel ratio), and lean air-fuel ratio.

A cylinder head 2 of the engine 1 is fitted with a solenoid-operated fuel injector 4 and a spark plug 3 for each cylinder. The fuel injector 4 is arranged to inject fuel directly into a combustion chamber 5. A hemispherical cavity 8 is formed in a top face of a piston 7, which is slidably disposed in a cylinder 6. The cavity is located at a position, which can be reached by fuel spray supplied from the fuel injector 4 when the fuel is injected in a latter stage of the compression stroke. The compression ratio of the engine 1 is set to a value (for example, about 12) larger than that of a manifold-injection type engine. A DOHC four-valve system is employed as a valve driving mechanism. An intake-side camshaft 11 and an exhaust-side camshaft 12 for respectively driving an intake valve 9 and an exhaust valve 10 are rotatably held in an upper portion of the cylinder head 2.

The cylinder head 2 is formed with intake ports 13, each of which extends substantially upright between the camshafts 11 and 12. Intake air flow, having passed through the intake port 13, can generate a counterclockwise tumbling flow, as viewed in FIG. 1, in the combustion chamber 5. Exhaust ports 14 extend substantially in the horizontal direction, as in the case of those of ordinary engines. A large-diameter exhaust gas recirculation (EGR) port 15 diverges diagonally downward from the exhaust port 14 concerned.

Reference numeral 16 denotes a water temperature sensor for detecting a cooling water temperature Tw. Reference numeral 17 denotes a vane type crank angle sensor for outputting a crank angle signal SGT in predetermined crank positions (e.g., 5° BTDC and 75° BTDC) for each cylinder. The crank angle sensor 17 is arranged to detect an engine rotation speed Ne based on the crank angle signal SGT. That is, the crank angle sensor 17 constitutes an engine rotation speed detecting means. Reference numeral 19 denotes an ignition coil for supplying a high voltage to the spark plug 3. One of the camshafts, which rotate at half the speed of the crankshaft, is fitted with a cylinder discriminating sensor (not shown) for outputting a cylinder discriminating signal, whereby the cylinder, for which the crank angle signal SGT is output, is discriminated.

The intake ports 13 are connected, through a suction manifold 21 including a surge tank 20, with an intake pipe 25 provided with a throttle body 23, a stepper motor type first air bypass valve (#1ABV 24), an air flow sensor (intake air quantity detecting means) 32, and an air cleaner 22.

The intake pipe 25 is provided with a large-diameter air bypass pipe 26, bypassing the throttle body 23, through which intake air is introduced to the intake manifold 21. A large linear-solenoid type second air bypass valve (#2ABV) 27 is disposed in the pipe 26. The air bypass pipe 26 has a flow area substantially equal to that of the intake pipe 25, so that a quantity of intake air, required for low or medium speed range of the engine 1, can flow through the pipe 26 when the #2ABV 27 is fully open.

The throttle body 23 is provided with a butterfly type throttle valve 28 for opening and closing the intake passage formed therein, a throttle position sensor (hereinafter referred to as TPS) 29 serving as a throttle valve opening degree sensor for detecting the opening degree of the throttle valve 28 or the throttle opening degree θth, and an idle switch 30 for detecting a fully-closed state of the throttle valve 28 to recognize an idling state of the engine 1. The TPS 29 outputs a throttle voltage VTH corresponding to the throttle opening degree θth, so that the throttle opening degree θth is recognized based on the throttle voltage VTH.

The throttle opening degree θth indicates a depressing state of the accelerator pedal 28*a* attached to the engine 1 as an accelerator member for engine speed adjustment. The TPS 29 constitutes an acceleration state detecting means for detecting an operation state of the accelerator pedal. The acceleration state detecting means may be one which detects the opening degree of the accelerator pedal, instead of the throttle opening degree.

The air flow sensor 32, which is used to detect an air suction amount Qa, is comprised of, for example, Karman vortex flow sensor. The air suction amount Qa may be obtained in accordance with a pressure in the intake pipe detected by a boost pressure sensor (not shown) provided in the surge tank 20.

The exhaust ports 14 are connected, through an exhaust manifold 41 provided with an $O_2$ sensor 40, with an exhaust pipe 43, which is provided with a three-way catalyst 42, a muffler (not shown) and the like. The EGR ports 15 are connected to the upstream of the intake manifold 21 through a large-diameter EGR pipe 44, in which a stepper motor type EGR valve 45 is provided.

A fuel tank 50 is disposed in the rear of a vehicle body (not shown). Fuel stored in the fuel tank 50 is sucked up by means of a motor-operated lower pressure fuel pump 51, and supplied to the engine 1 through a low-pressure feed pipe 52. The fuel pressure in the feed pipe 52 is adjusted to a relatively low pressure (low fuel pressure) by a first fuel pressure regulator 54, which is inserted in a return pipe 53. The fuel supplied toward the engine 1 is fed into each fuel injector 4 through a high-pressure feed pipe 56 and a delivery pipe 57 by means of a high-pressure fuel pump 55, which is attached to the cylinder head 2.

The high-pressure fuel pump 55, which is of a swash-plate axial-piston type, is driven by the exhaust-side camshaft 12 or the intake-side camshaft 11. The pump 55 is capable of producing a fuel pressure of more than 5 MPa–7 MPa even when the engine 1 is in idle operation. The fuel pressure in the delivery pipe 57 is adjusted by a second fuel pressure regulator 59 disposed in a return pipe 58, to a relatively high pressure (high fuel pressure).

Reference numeral 60 denotes a solenoid-operated fuel pressure selector valve attached to the second fuel pressure regulator 59. This fuel pressure selector valve 60 relieves fuel when it is ON, to lower the fuel pressure in the delivery pipe 57 to a low fuel pressure. Reference numeral 61 denotes a return pipe for returning part of fuel used for lubrication or cooling in the high pressure fuel pump 55 to the fuel tank 50.

An ECU (electronic control unit) 70 is provided in a passenger cabin of the vehicle and includes an I/O unit, storage units (ROM, RAM, BURAM, etc.) used to store control program, control map and the like, central processing unit (CPU), timer counter, and the like. The ECU 70 conducts an overall control of the engine 1.

The above described various sensors are connected to the input side of the ECU 70 so that pieces of detection information from these sensors are input. In accordance with the detection information, the ECU 70 determines fuel injection mode, fuel injection amount, ignition timing, EGR gas introduction amount and the like, and then controls the fuel injector 4, the ignition coil 19, the EGR valve 45 and the like. In addition to the aforementioned sensors, a number of switches and sensors (not shown) are connected to the input side of the ECU 70 although a description thereof is omitted, and on the other hand, various alarm lamps, equipment and the like (not shown) are connected to the output side of the ECU.

The engine 1 having the above described construction is operated under the control of a control apparatus mainly comprised of the ECU 70.

Combustion control in the engine 1 by the control apparatus will be described.

If a driver turns on an ignition key to thereby start the engine 1, the ECU 70 switches on the low-pressure fuel pump 51 and the fuel pressure selector valve 60, so that the fuel injectors 4 are supplied with fuel at low pressure.

When the vehicle driver further turns the ignition key to start an engine operation, the engine 1 is cranked by a self starter (not shown) and at the same time, fuel injection control by the ECU 70 is started. At this time, the ECU 70 selects a first-term injection mode (intake-stroke injection mode), whereupon fuel is injected at a relatively rich air-fuel ratio. The reason why the first-term injection mode is selected at start of the engine resides in that, if the second-term injection mode where fuel injection is performed at timing, which lies in a latter stage of the compression stroke, is selected at start of the engine, at which the fuel is supplied to the fuel injector 4 at a low fuel pressure, then fuel supply for supplying a desired amount of fuel cannot be sometimes completed within a predetermined time period since the pressure in the cylinder is considerably high in the latter stage of the compression stroke. Further, the ECU 70 closes the #2ABV 27 at the time of starting the engine 1. Thus, the intake air is supplied to the combustion chamber 5 through a gap around the throttle valve 28 and a bypass line, in which the #1ABV 24 is disposed. The #1ABV 24 and the #2ABV 27 are controlled unitarily by the ECU 70. The opening degrees of the valves 24 and 27 are determined depending on a required introduction amount of the intake air (bypass air) which is supplied bypassing the throttle valve 28.

When the engine 1 starts idle operation after engine starting operation is completed, the high-pressure fuel pump 55 starts a rated discharge operation. The ECU 70 turns off the fuel pressure selector valve 60 and supplies a high-pressure fuel to the fuel injector 4. A fuel injection quantity required at this time is determined by fuel pressure in a delivery pipe 57 adjusted by a second fuel pressure regulator 59, a fuel pressure detected by a fuel pressure sensor (not shown) provided in the delivery pipe 57, and a valve opening time of the fuel injector 4 or fuel injection time.

Until the cooling water temperature Tw reaches a predetermined value, the ECU 70 selects the first-term injection mode, as in the case of engine startup to inject fuel, to ensure a rich air-fuel ratio, and at the same time, still keeps the #2ABV 27 closed. This is because misfire or discharge of unburnt fuel (HC) is unavoidable if fuel is injected in a second-term mode (compression-stroke injection mode), since the vaporization rate of fuel is low when the engine 1 is cold. The idle speed control, based on a variable load, applied to the engine, of the auxiliaries such as air conditioner, is carried out by adjusting the opening degree of the #1ABV 24, as in the case of a manifold-injection type engine.

When the engine is cold, fuel injection control is effected substantially in the same manner as in the case of manifold-injection engine. Since no fuel drops adhere to the wall surface of the intake pipe 13, the response and accuracy of control are higher than in the case of the manifold-injection engine.

Figure 2:
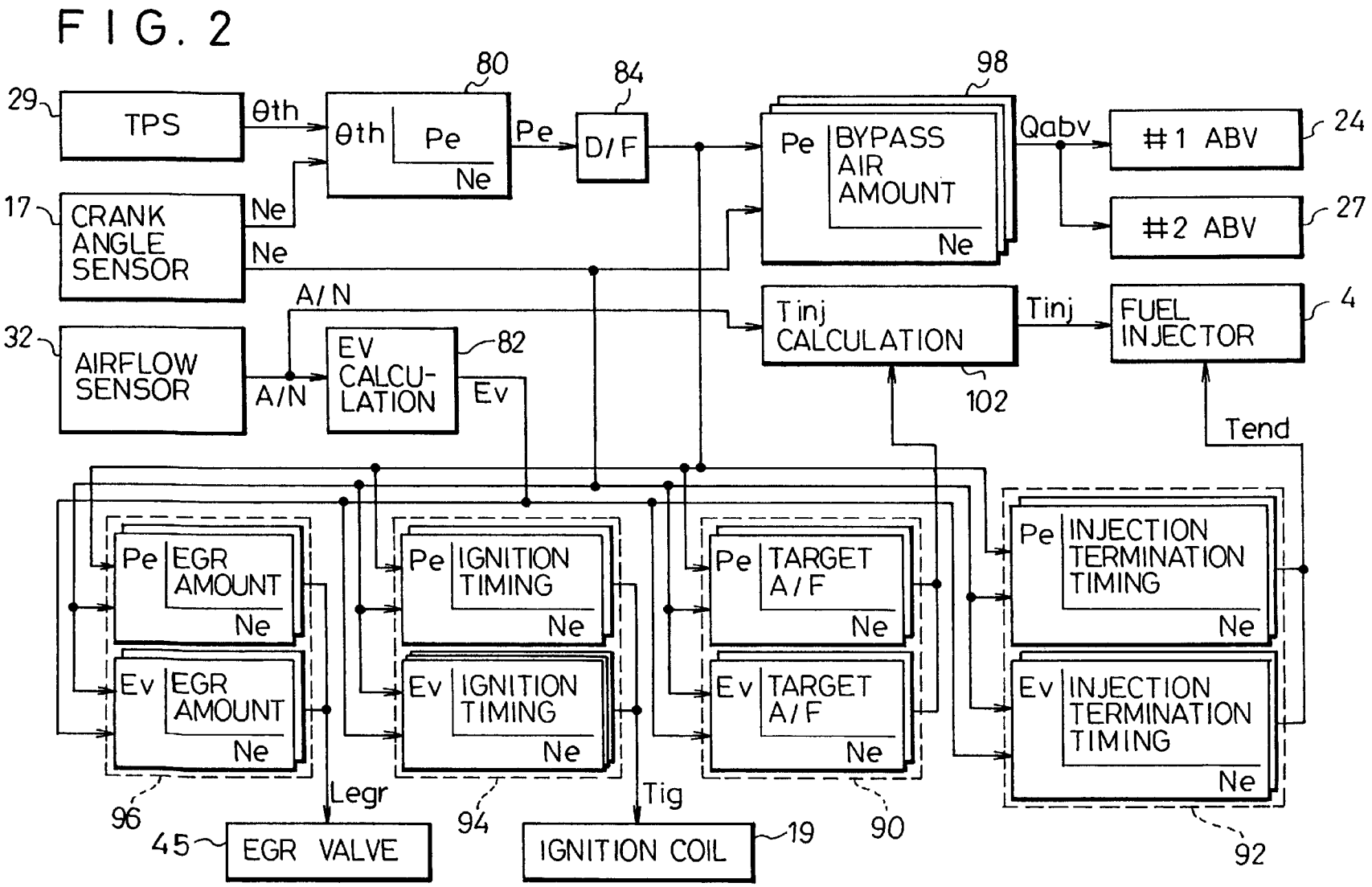
FIG. 2 is a block diagram showing various calculating sections such as a target average effective pressure calculating section, a volumetric efficiency calculating section, and a target A/F calculating section of an electronic control unit in the control unit shown in FIG. 1.

Referring to FIG. 2, a procedure of combustion control, which is carried out by the ECU 70 after warm-up operation is completed, will be described.

When warm-up operation for the engine 1 is completed, the ECU 70, having the functions of respective functional sections 80 to 102 shown in FIG. 2, reads throttle opening information θth based on a throttle voltage from the TPS 29, an engine rotation speed Ne from the crank angle sensor 17, and intake air amount information Qa from the air flow sensor 32.

Then, a Pe calculating section (first load-related value calculating means) 80 calculates a target engine output or a target average effective pressure (first load-related value) in accordance with a throttle voltage VTH supplied from the TPS 29 and indicative of a throttle opening degree information θth and engine rotation speed information Ne supplied from the crank angle sensor 17. Actually, a target average effective pressure Pe is read from a map, in which a relation between the throttle opening degree information θth and engine rotation speed Ne is set in advance, as shown in a block of the Pe calculating section 80 in FIG. 2.

An Ev calculating section (second load-related value calculating means) 82 calculates a volumetric efficiency (second load-related value) in accordance with intake air amount information Qa supplied from the air flow sensor 32. In this calculation, actually, an intake air amount per intake stroke A/N (hereinafter referred to as unit intake air amount A/N), calculated from the engine rotation speed Ne and an output signal of the airflow sensor 32, is used as the intake air amount information Qa.

The target average effective pressure Pe and the volumetric efficiency Ev obtained in the manner, as well as the engine rotation speed Ne signal, are supplied to a target A/F calculating section (target air-fuel ratio calculating means) 90, an injection termination timing calculating section 92, an ignition timing calculating section 94, and an EGR amount calculating section 96. Various combustion parameters such as a target air-fuel ratio (hereinafter referred to as A/F), fuel injection termination timing Tend, ignition timing Tig, and EGR amount Legr are respectively set in the target A/F calculating section 90, the injection termination timing calculating section 92, the ignition timing calculating section 94, and the EGR amount calculating section 96.

The respective calculating sections 90, 92, 94, and 96 include a plurality of combustion parameter setting maps based on engine rotation speed Ne and target average effective pressure Pe, and a plurality of combustion parameter setting maps based on engine rotation speed Ne and volumetric efficiency Ev.

More specifically, the calculating sections 90, 92, and 94 include a second-term injection mode map based on engine rotation speed Ne and target average effective pressure Pe, and first-term injection mode maps based on engine rotation speed Ne and volumetric efficiency Ev.

Figure 3:
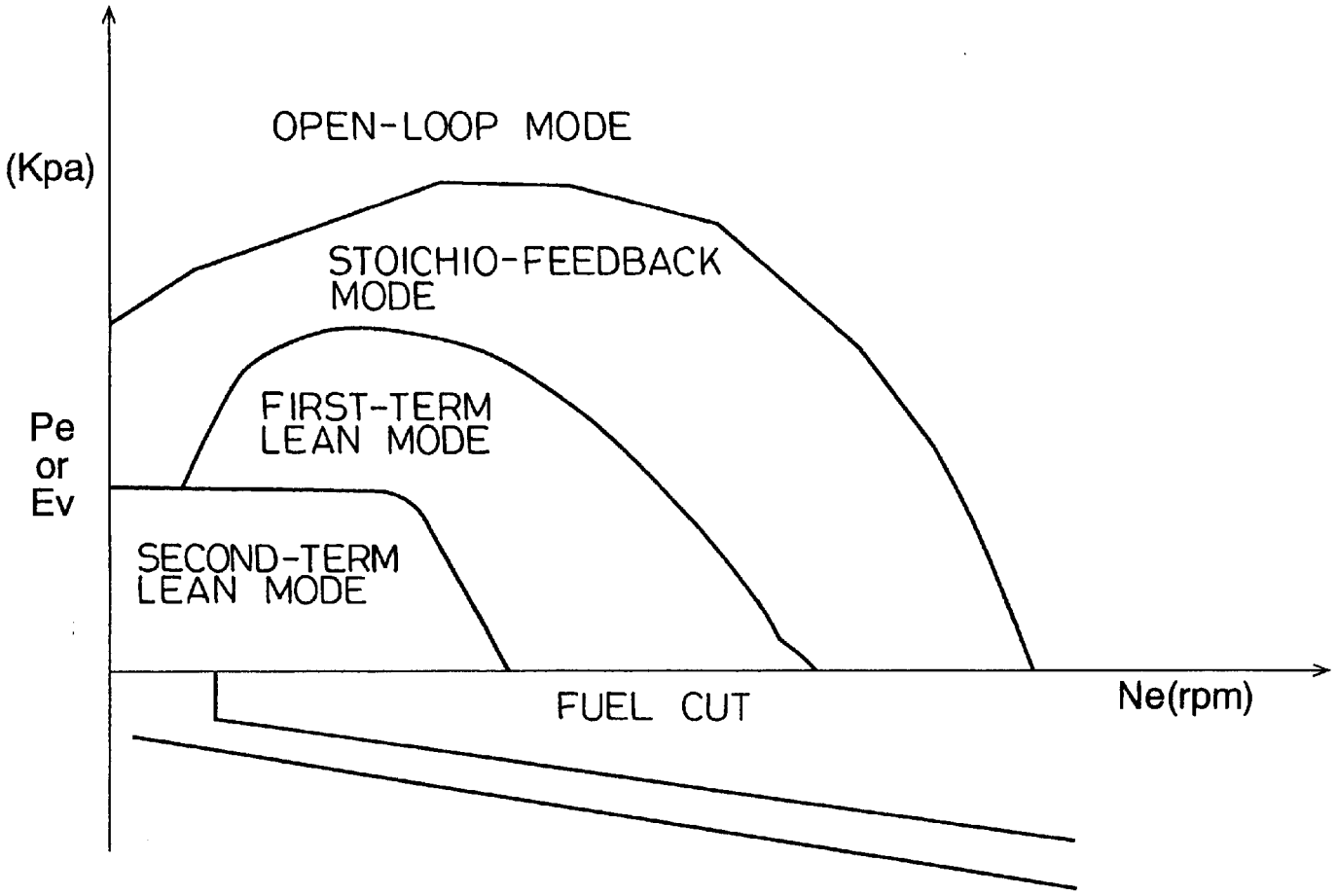
FIG. 3 is a diagram showing a map which is referred to at the time of determining a fuel injection mode.

Here, the second-term injection mode indicates a second-term injection lean mode shown in FIG. 3. The first-term injection mode refers to first-term injection lean mode, stoichio-feedback (S-F/B) mode, and open loop (O/L) mode shown in FIG. 3. These three injection modes are called as the first-term injection mode.

The calculating sections 90, 92, and 94 are each stored with a second-term injection lean mode map as the second-term injection mode map, and a first-term injection lean mode map, S-F/B mode map and O/L mode map serving as the first-term injection maps.

As described above, in the second-term injection mode, a combustion parameter is determined in accordance with engine rotation speed Ne and target average effective pressure Pe. In the first-term injection mode, a combustion parameter is determined in accordance with engine rotation speed Ne and volumetric efficiency Ev. The reason for doing this is as follows: a low correlation is found between engine load and volumetric efficiency Ev because the #1ABV 24 and #2ABV 27 are opened so that a large amount of bypass air is introduced to the combustion chamber through two bypass passages, in which these two valves 24, 27 are disposed, whereas a high correlation is found between target average effective pressure Pe and engine load, which pressure Pe has a correlation with an acceleration state of an accelerator member operated by the driver. In the first-term injection mode, in which fuel is injected in the intake stroke, the aforementioned bypass air amount is small, and thus a high correlation is found between engine load and volumetric efficiency Ev.

As for the second-term injection lean mode, a map used at the time of executing exhaust gas recirculation (EGR) and a map used at the time of non-executing the EGR are provided. For the ignition timing maps for S-F/B mode and O/L mode which are used in the ignition timing calculating section 94, a map used at the time of executing the EGR and a map at the time of non-executing the EGR are provided.

The EGR amount calculating section 96 includes a second-term injection lean mode map based on engine rotation speed Ne and target average effective pressure Pe, and a first-term injection mode map based on engine rotation speed Ne and volumetric efficiency Ev. The respective injection mode maps include a map used when a selector lever of a transmission (not shown) is in neutral range (N range) and a map used when the selector lever in a range other than the N range.

The ECU 70 stores a fuel-injection-mode setting map shown in FIG. 3. In accordance with the map shown in FIG. 3, the fuel injection mode is changed over among the second-term lean mode, first-term injection lean mode, S-F/B mode, and O/L mode, depending on engine rotation speed Ne and target average effective pressure Pe, or depending on engine rotation speed Ne and volumetric efficiency Ev.

More specifically, a changeover between the second-term injection lean mode and the first-term injection lean mode, and between the second-term injection lean mode and the S-F/B mode, that is, a changeover between the second- and first-term injection modes, is carried out depending on engine rotation speed Ne and target average effective pressure Pe. On the other hand, a changeover between the first-term injection lean mode and S-F/B mode and between the S-F/B mode and the O/L mode, that is, a changeover between modes belonging to the first-term injection mode, is carried out depending on either target average effective pressure Pe or volumetric efficiency Ev and engine rotation speed Ne.

If it is determined that a fuel injection mode determined from the map shown in FIG. 3 is the second-term injection mode, an associated one of the maps based on engine rotation speed Ne and target average effective pressure Pe is selected depending on whether or not the EGR is carried out, in each of the target A/F calculating section 90, the injection termination timing calculating section 92, the ignition timing calculating section 94, and the EGR amount calculating section 96. With reference to the selected map, each calculating section 90, 92, 94 or 96 sets an associated one combustion parameter, i.e., target A/F, injection termination timing Tend, ignition timing Tig, or EGR amount Legr.

As shown in FIG. 2, a signal indicative of target average effective pressure Pe is also supplied to the bypass air amount calculating section 98 through a D/F filter 84. In the bypass air amount calculating section 98, a bypass air amount Qabv supplied through the air bypass pipe 26 is set based on engine rotation speed Ne and target average effective pressure Pe.

When the first-term injection mode is selected, each of the target A/F calculating section 90, injection termination timing calculating section 92, ignition timing calculating section 94, and EGR amount calculating section 96 selects an associated one map, based on engine rotation speed Ne and volumetric efficiency Ev, in dependence on which injection mode is determined among the first-term injection lean mode, S-F/B mode and O/L mode, and in dependence on whether or not the select lever is in the N range. Each of the calculating sections 90, 92, 94, and 96 sets an associated one combustion parameter, i.e., the target A/F, injection termination timing Tend, ignition timing Tig, or EGR amount Legr.

As mentioned in the above, the target A/F, fuel injection termination timing Tend, ignition timing Tig, EGR amount Legr and bypass air amount Qabv are set.

A signal indicative of the unit intake air amount A/N, obtained as the intake air amount information Qa by the Ev calculating section 82 and a signal indicative of the target A/F obtained by the calculating section 90, are supplied to a Tinj calculating section (fuel injection amount calculating means) 102, which sets a fuel injection time (valve opening time) Tinj.

A procedure for setting the fuel injection time Tinj will be described with reference to FIG. 15.

Figure 15:
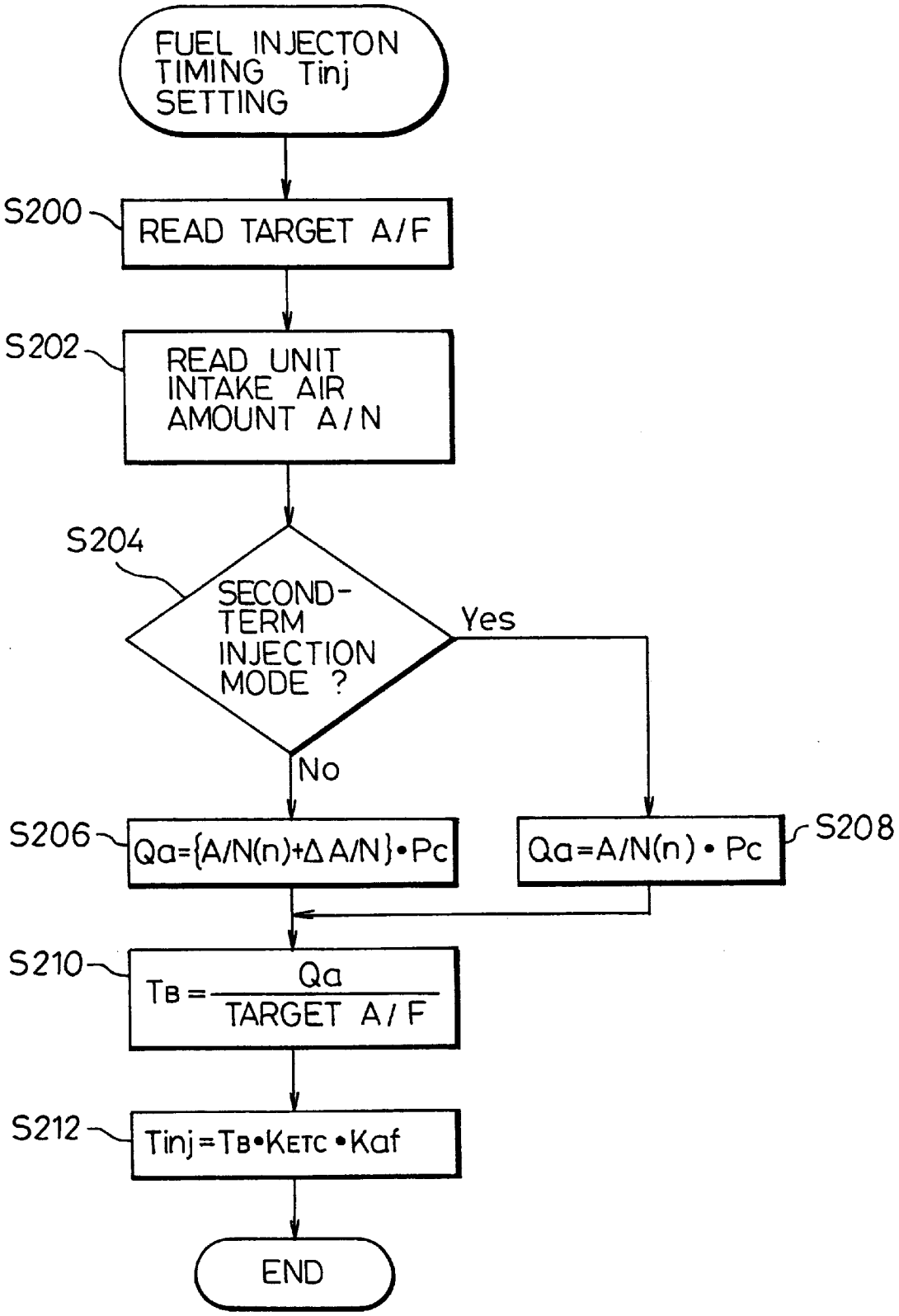
FIG. 15 is a flowchart showing a setting routine for fuel injection timing Tinj.

The Tinj setting routine shown in FIG. 15 is periodically executed by the ECU 70.

In steps S200 and S202, the target A/F and the unit intake air amount A/N are read.

In the next step S204, whether or not the fuel injection mode is the second-term injection mode is determined. If the result of this determination is No or if it is determined that the fuel injection mode is not the second-term injection mode but the first-term injection mode, the control flow proceeds to step S206.

In step S206, the intake air amount Qa is calculated according to the following expression (1) (correcting means):

$$Qa=(A/N(n)+\Delta A/N)\cdot Pc \quad (1)$$

where A/N(n) is a unit intake air amount detected in the present Tinj setting period, and ΔA/N is a difference between the unit intake air amount A/N(n) detected in the present period in respect of a certain cylinder and the unit intake air amount A/N(n−1) detected in the preceding period in respect of another cylinder. Thus, ΔA/N indicates a quantity of change in the unit intake air amount (ΔA/N=A/N(n)−A/N(n−1)). Pc is a conversion coefficient.

As in the case of a manifold-injection engine, a delay in suction of intake air should be taken into account when a cylinder-injection engine is operated in the first-term injection mode. Thus, in this embodiment, the intake air amount Qa is corrected by using the quantity of change ΔA/N in the unit intake air amount per Tinj setting period, to ensure a proper combustion control in the first-term injection mode.

In the next step S210, a reference value TB of fuel injection time is calculated based on the target A/F and intake air amount Qa in accordance with the following expression (2):

$$TB=Qa/(\text{target } A/F) \quad (2)$$

In step S212, a fuel injection time Tinj is calculated according to the following expression (3):

$$Ting=TB\cdot Kaf\cdot KETC+Td \quad (3)$$

where Kaf is a correction coefficient used to correct the target A/F, KETC is a correction coefficient of the fuel injection time Tinj, which is set in dependence on detection information from various sensors indicative of engine operating state, and Td is a dead time correction value. The correction coefficient KETC is a product of correction coefficients, which are set depending on engine water temperature Tw, atmospheric temperature Tat, atmospheric pressure Tap and the like. As for the correction coefficient Kaf, a detailed explanation will be given later.

If the result of the determination at step S204 is Yes or if it is determined that the fuel injection mode is the second-term injection mode, the control flow proceeds to step S208.

In step S208, unlike the case of the first-term injection mode, the intake air amount Qa is calculated based on the unit intake air amount A/N(n) detected in the present period in accordance with the next expression (4):

$$Qa=A/N(n)\cdot Pc \quad (4)$$

As described above, in the second-term injection mode, the intake air amount Qa is obtained in accordance with only the unit intake air amount A/N(n) detected in the current period. The reason is as follows: In the second-term injection mode where fuel is injected in the compression stroke, the suction of intake air is already finished before the calculation of the fuel injection time Tinj based on the expression (3) is started. In other words, an accurate fuel injection time Tinj can be properly calculated by using the unit intake air amount A/N(n) detected in the current period. Conversely, if the above correction is conducted in the second-term injection mode, there is a possibility that the fuel injection time Tinj may become inaccurate.

By calculating the intake air amount Qa in accordance with different expressions between the first-term injection mode and the second-term injection mode, the fuel injection time Tinj or fuel injection amount is adjusted appropriately in both the first- and second-term injection modes, to thereby attain an actual A/F which coincides with the target A/F, so that a proper engine operating state is always maintained.

In the second-term injection mode, usually, the fuel injection amount can be set easily with use of the throttle opening information θth from the TPS 29. However, in this embodiment, the throttle opening information is not directly used in the setting of the fuel injection amount. Alternatively, the fuel injection time Tinj is calculated in accordance with expression (3) on the basis of the target A/F which is obtained in accordance with throttle opening θth (see, Pe calculating section 80 and target A/F calculating section 90 in FIG. 2), whereupon the fuel injection amount is determined.

The reason for doing this is as follows: In the case of determining the fuel injection amount by way of the calculation of the target A/F, a fuel injection control is carried out, while the target A/F is always managed or controlled. If the target A/F can be controlled in this manner, a very excellent and appropriate combustion control can be continued regardless of combustion injection mode.

When the fuel injection time Ting is set in the aforementioned manner, a signal indicative of the fuel injection time Tinj is supplied to the fuel injector 4 concerned. Then, an amount of fuel corresponding to the fuel injection time Tinj is injected from the fuel injector 4, as described above. At this time, a signal indicative of the fuel injection termination timing Tend is also supplied to the fuel injector 4, so that the fuel injection timing is ascertained.

A signal indicative of the ignition timing Tig is supplied from the ignition timing calculating section 94 to the ignition coil 19, and a signal indicative of the EGR amount Legr is supplied from the EGR amount calculating section 96 to the EGR valve 45. Further, a signal indicative of the bypass air amount Qabv is supplied from the bypass air amount calculating section 98 to the #1ABV and #2ABV. Whereupon, an optimum combustion control is carried out.

In case that the engine runs idle or at a low speed, for instance, so that the engine 1 is in a low load range, the second-term injection lean mode is selected in accordance with FIG. 3. In this case, a fuel injection amount is determined to correspond to a lean target A/F (e.g., A/F=30–40) determined based on the target average effective pressure Pe. Further, an ignition timing Tig and an EGR amount Tegr are set based on the target average effective pressure Pe. Then, fuel injection is carried out in the compression stroke and simultaneously an ignition timing control and an EGR control are carried out, whereby an excellent combustion control is carried out.

Combustion in the second-term injection lean mode will be described in detail. In the cylinder-injection type engine 1, the cavity 8 is formed on the top face of the piston 7, as described above. Thus, an intake air flow entered into the combustion chamber through the intake port 13 forms the aforementioned tumbling flow along the cavity 8, so that fuel spray, i.e., an air-fuel mixture of fuel injected from the fuel injector 4 and intake air, is concentrated around the spark plug 3 appropriately. As a result, at the ignition timing, an air-fuel mixture having an approximate stoichiometric air-fuel ratio AFS is always formed in layer around the spark plug 3. Therefore, in the second-term injection mode, an excellent ignition performance is assured even if the air-fuel ratio is as a whole lean.

In case that the engine operate at a constant speed, for instance, so that the engine 1 is in a medium load range, the first-term injection lean mode or the S-F/B mode is selected in accordance with FIG. 3. In the first-term injection mode, a fuel injection amount, corresponding to a relatively lean target A/F (e.g., A/F=20) determined based on the volumetric efficiency Ev, is obtained. Further, an ignition timing Tig and an EGR amount Legr are determined based on the volumetric efficiency Ev. Then, fuel injection is conducted in the intake stroke, while an excellent combustion control is performed.

In the S-F/B mode as well, fuel injection is conducted in the intake stroke, and an ignition timing Tig and an EGR amount Legr are determined based on the volumetric efficiency Ev. In the S-F/B mode, an air-fuel ratio feedback control is performed in accordance with the output voltage of the $O_2$ sensor 40, to attain the target A/F equal to the stoichiometric air-fuel ratio AFS.

In case that the engine is rapidly accelerated or operates at a high speed, for instance, so that the engine 1 is in a high load range, the fuel injection mode is set to the O/L mode in accordance with FIG. 3. In this case, the first-term injection mode is selected and fuel injection is performed in the intake stroke. At this time, the target A/F is set based on the volumetric efficiency Ev, to assure a relatively rich air-fuel ratio. The ignition timing Tig and the EGR amount Legr are set in accordance with the volumetric efficiency Ev. Whereupon, a proper combustion control is carried out.

In case that the engine is coasting at a medium or high speed, the fuel injection mode becomes the fuel cut mode as shown in FIG. 3, so that fuel injection is halted. When the engine rotation speed Ne drops below a restorative rotation speed or when the vehicle driver depresses the accelerator pedal, fuel injection is immediately stopped.

Referring to FIGS. 4–11, a procedure for combustion parameter control at the time of changeover of injection mode will be described in respect of the mode changeover between the second-term lean mode and the S-F/B mode, between the first-term lean mode and the S-F/B mode, and between the first-term lean mode and the second-term lean mode, as an example.

The combustion parameter setting routine shown in FIGS. 4–11 is executed each time a predetermined crank angle position of each cylinder is detected by the ECU 70, whereby combustion parameters, affecting combustion state in the combustion chamber of the engine, such as valve opening time Tinj of the fuel injector 4, ignition timing Tig, valve opening amount Legr of the EGR valve 45, are determined.

Figure 4:
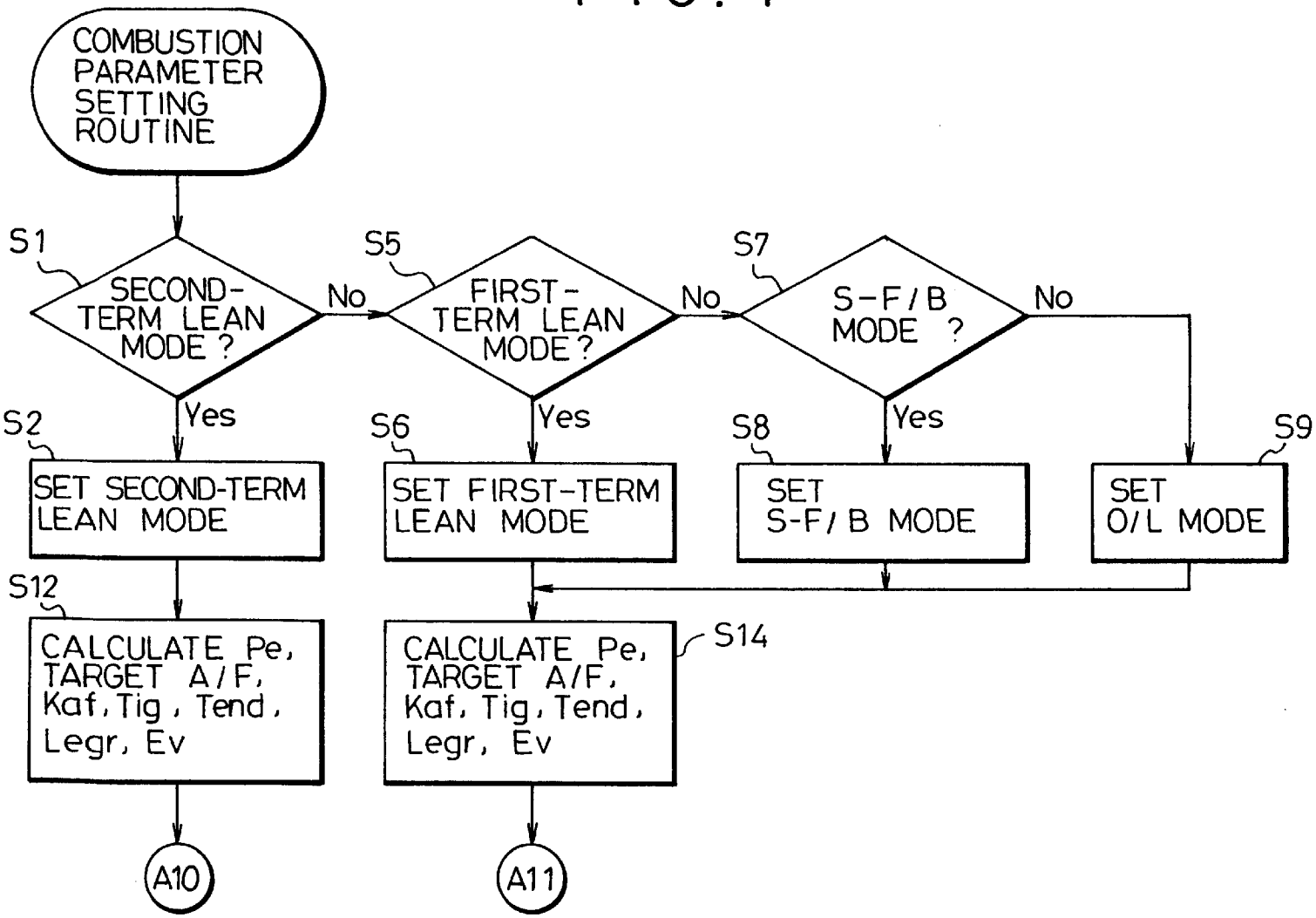
FIG. 4 is a flowchart showing part of a combustion parameter setting routine in which various combustion parameter values are set.

At steps S1–S9 shown in FIG. 4, the ECU 70 first determines and sets the fuel injection mode in accordance with the map shown in FIG. 3. If the result of determination in step S1 is Yes or if it is determined that the fuel injection mode is the second-term injection lean mode, the second-term lean mode is set in step S2. Then, various combustion parameters Pe, Ev, target A/F, Tig, Tend, and Legr, and a correction coefficient Kaf used to correction the target A/F are set. In the second-term lean mode, various combustion parameters, such as the target A/F, injection termination timing Tend, ignition timing Tig, and EGR amount Legr, are set based on the target average effective pressure Pe, as described above.

On the other hand, if the result of determination in step S1 is No, whether or not the fuel injection mode is the first-term lean mode is determined in step S5. If the result of determination in step S5 is Yes, the first-term lean mode is set in step S6. Next, various combustion parameters Pe, Ev, target A/F, Tig, Tend and Legr, and a correction coefficient Kaf for the target A/F are set in step S14, in order to conduct a control in the first-term lean mode. In the first-term lean mode, the target A/F, injection termination timing Tend, ignition timing Tig, and EGR amount Legr are set in accordance with volumetric efficiency Ev, as described above.

If the result of determination in step S5 is No, the control flow proceeds to step S7. If the result of determination in step S7 is Yes or if the fuel injection mode is determined to be S-F/B mode, the S-F/B mode is set in step S8, and the control flow proceeds to step S14 as in the case of the first-term lean mode, because the S-F/B mode belongs to the first-term injection mode. If the result of determination in step S7 is No or if the fuel injection mode is determined to be the O/L mode, the O/L mode is set in step S9, and step S14 is executed because the O/L mode belongs to the first-term injection mode.

In each of the steps S2, S6, and S8, tailing coefficient values K1, K2, KS and KL are set, as will be described in detail. These coefficient values, which are used at the time of transition of the injection mode, are each set to a value of 1.0 in step S2, S6 or S8, in the combustion parameter setting period in which no injection mode transition is discriminated. On the other hand, in a period, in which the transition of the fuel injection mode is determined for the first time, a corresponding one of the coefficients is set to a value of 0. For example, in a combustion parameter setting period, in which a transition from the S-F/B mode or the first-term lean mode to the second-term lean mode is determined for the first time, the tailing coefficient value K1 is reset to a value of 0 in step S2. In a period, in which a transition from the second-term lean mode to the S-F/B mode or the first-term lean mode is determined for the first time, the tailing coefficient value K2 is reset to a value of 0 in step S8 or S6. Further, in a period, in which a transition from the first-term lean mode to the S-F/B mode is initially determined, the tailing coefficient value KL is reset to a value of 0 in step S8. Moreover, in a period, in which a transition from the S-F/B mode to the first-term lean mode is initially determined, the tailing coefficient value KS is reset to a value of 0 in step S6.

For convenience for description, a case, in which a combustion control is carried out in the second-term lean mode, will be first described.

Figure 5:
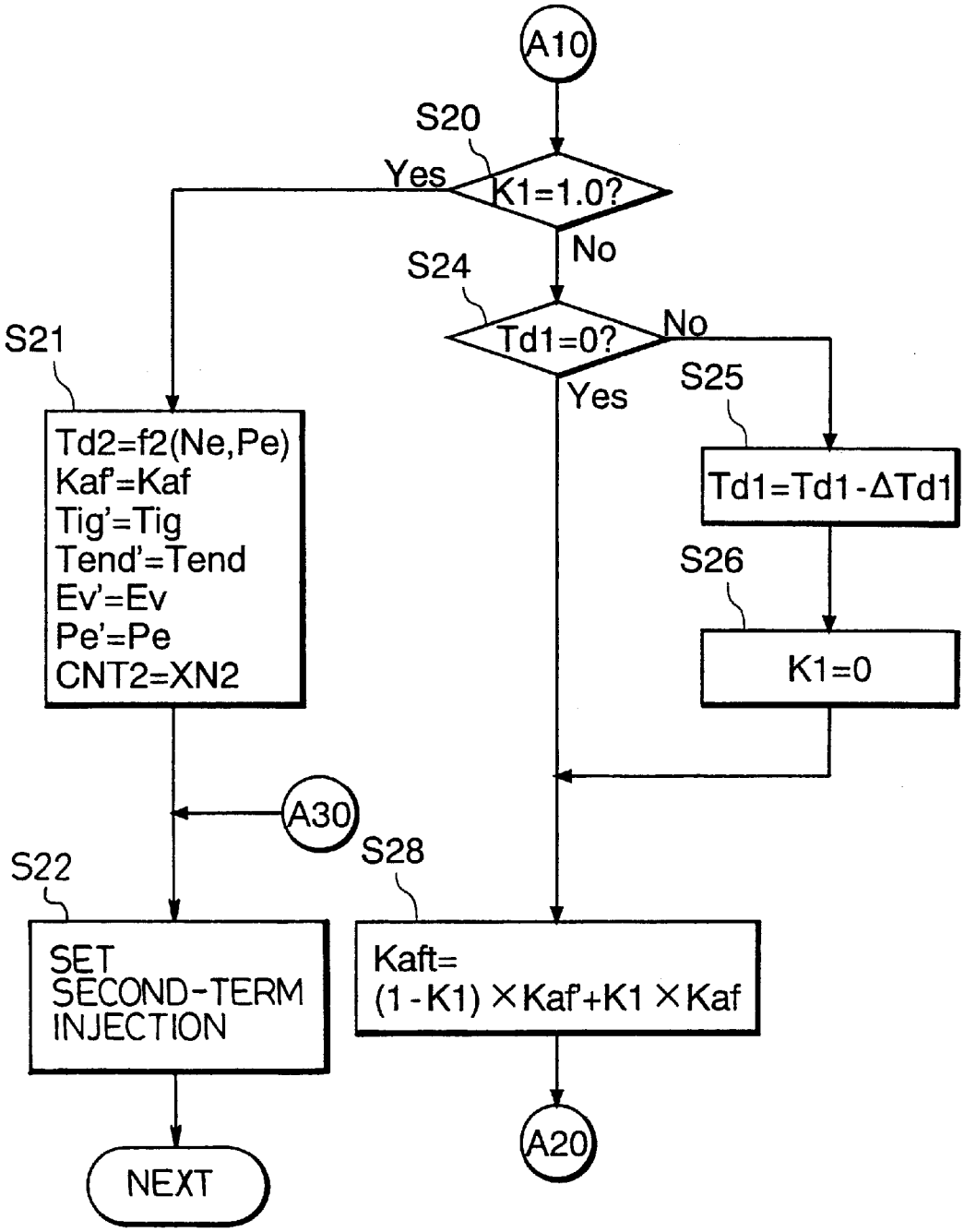
FIG. 5 is a flowchart showing another part, continued from FIG. 4, of the combustion parameter setting routine.

In case that the combustion control in the second-term lean mode is carried out, the control flow proceeds, through steps S1, S2 and S12, to step S20 in FIG. 5 in which whether or not the tailing coefficient value K1 is at a value of 1.0 is determined. As described above, the tailing coefficient value K1 is at a value of 1.0 when a transition to the second-term lean mode is completed. Therefore, if the second-term lean mode is set continuously from the preceding period, the tailing coefficient value K1 is at a value of 1.0 and thus the control flow proceeds to step S21.

In step S21, a preparation for combustion control in the second-term injection mode to be executed in the current period and a preparation for a transition from the second-term injection mode to the first-term injection mode are made. More specifically, initial values of various control variables such as a dead period, a delay in suction of intake air are set. A correction coefficient Kaf and combustion parameters Pe, Ev, Tig, Tend, Legr and the like which are calculated in step S12 of the current period are stored for use in a second-term lean mode control effected in the current period. The initial values of various control variables are stored in counters corresponding thereto, respectively. A dead time, counter Td2 is stored with the initial value f2(Ne, Pe) of the dead time which is set in dependence on target average effective pressure Pe and engine rotation speed Ne. A suction delay counter CNT2 is stored with an initial value XN2 of a delay in suction of intake air is set. Each of the control variables is initialized and the stored values such as the correction coefficient Kaf is renewed each time step S21 is executed.

In step S22, a fuel injection control in the second-term injection mode is set up in accordance with the correction coefficient Kaf and various combustion parameters stored in step S21.

In the following, a transition control from the second-term lean mode to the S-F/B mode will be described with reference to flowcharts shown in FIGS. 4–13 and a time chart shown in FIG. 14.

Figure 14:
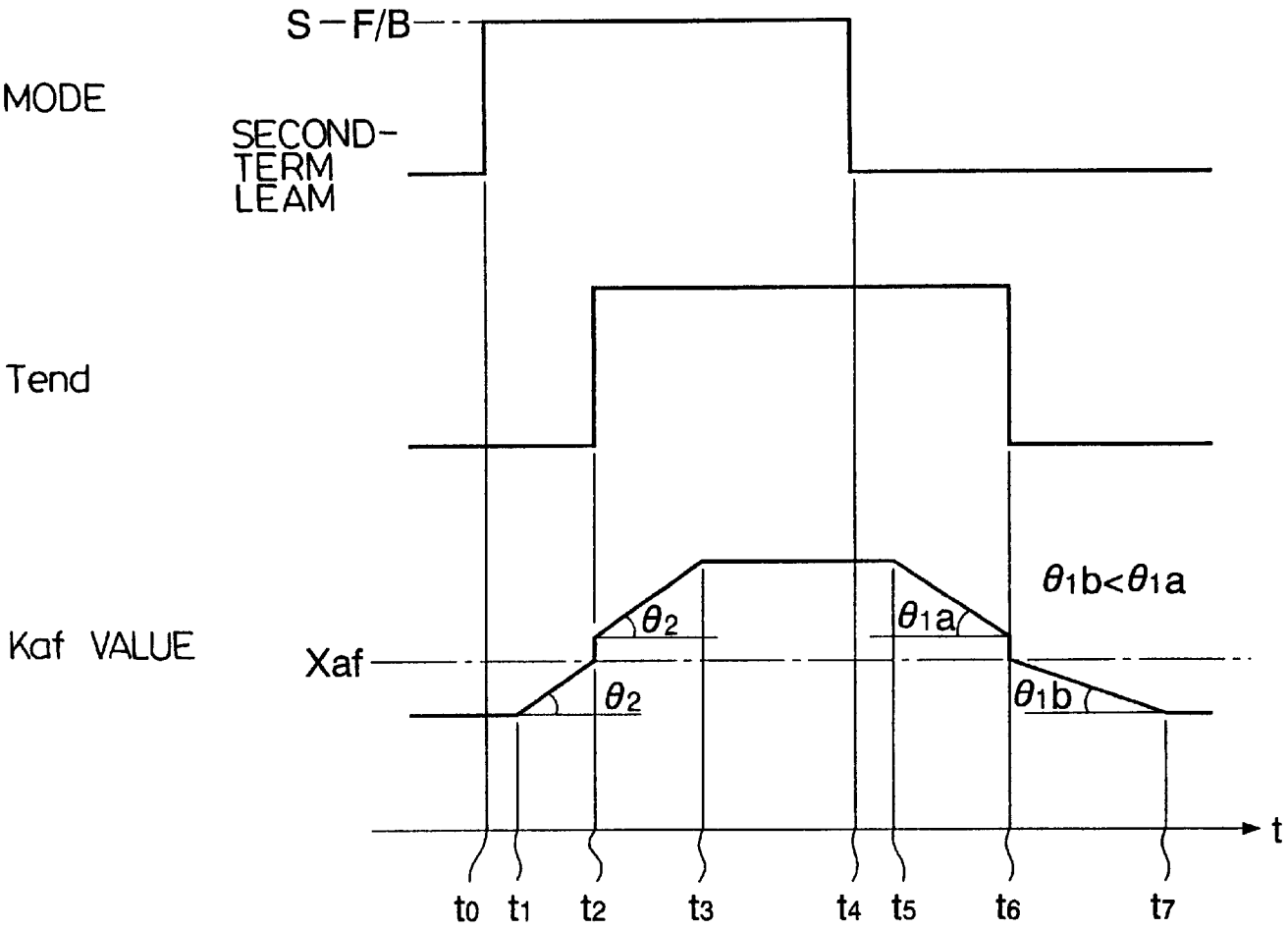
FIG. 14 is a time chart showing a change in fuel injection mode, fuel injection termination timing Tend, target A/F correction coefficient value Kaf with elapse of time, during a mode transition control between the S-F/B mode and the second-term lean mode.

FIG. 14 shows time-based changes in fuel injection mode, injection termination timing Tend and correction coefficient Kaf for the target A/F, which are caused during a transition from the second-term lean mode to the S-F/B mode.

When the second-term lean mode is in transition to the S-F/B mode, the control flow proceeds to step S7 through steps S1 and S5. In this case, it is determined at step S7 that the injection mode is the S-F/B mode, and the tailing coefficient value K2 is set to a value of 0 in step S8 (time point t0 in FIG. 14). Then, the aforementioned step S14 is executed.

In this case, various combustion parameters, such as target A/F, injection termination timing Tend, ignition timing Tig, and EGR amount Legr, are set in accordance with the volumetric efficiency Ev calculated from the intake air amount Qa, as described previously, because the S-F/B mode belongs to the first-term injection mode.

Figure 8:
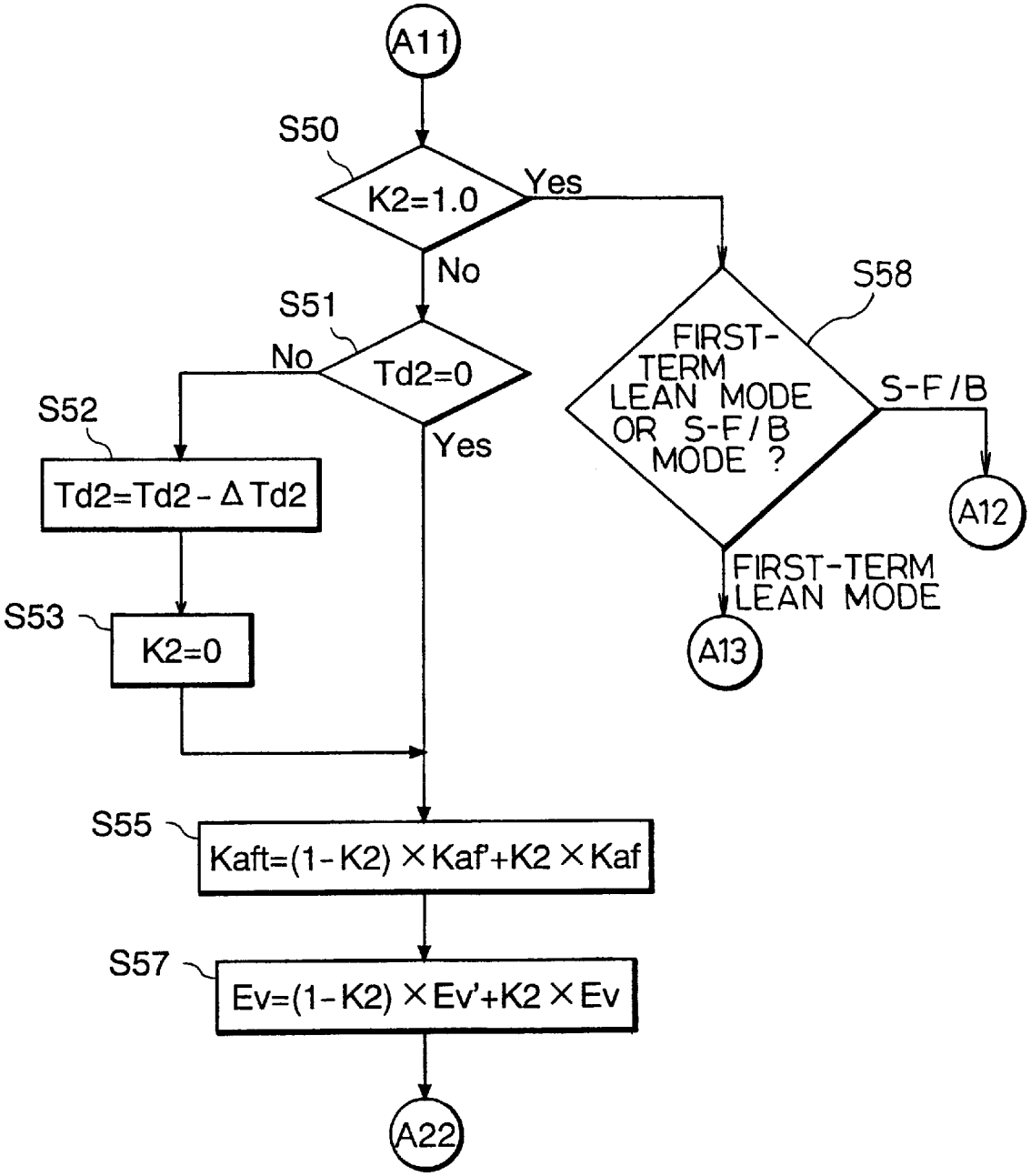
FIG. 8 is a flowchart showing a different part, continued from FIG. 4, of the combustion parameter setting routine.

Then, the control flow proceeds from step S14 to step S50 in FIG. 8. In step S50, whether or not the tailing coefficient value K2 is a value of 1.0 is determined. This tailing coefficient value K2 is set at a value of 0 just after the transition to the S-F/B mode is started. Thus, the result of determination in step S50 is No and hence transition processing from the second-term lean mode to the S-F/B mode is conducted by executing step S51 and the subsequent steps. The tailing coefficient value K2 becomes a value of 1.0 if the transition processing is completed. Until the coefficient value K2 becomes a value of 1.0 or until the transition to the S-F/B mode is completed, transition processing is carried out, which processing corresponds to the coefficient value K2 obtained by adding a minute value ΔK2 to the tailing coefficient value K2 in sequence in a timer routine which will be described later (see FIGS. 12 and 13).

Figure 12:
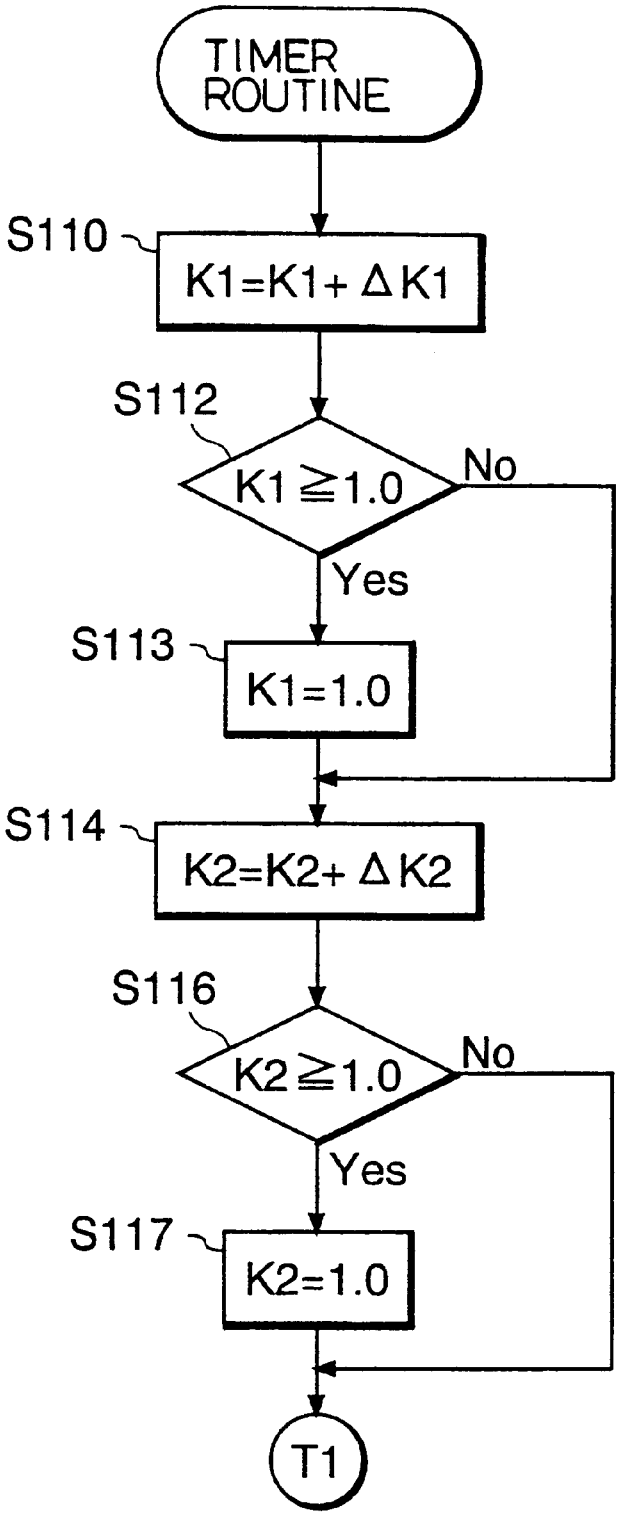
FIG. 12 is a flowchart showing part of timer routine executed by the control unit each time an interruption signal is generated.
Figure 13:
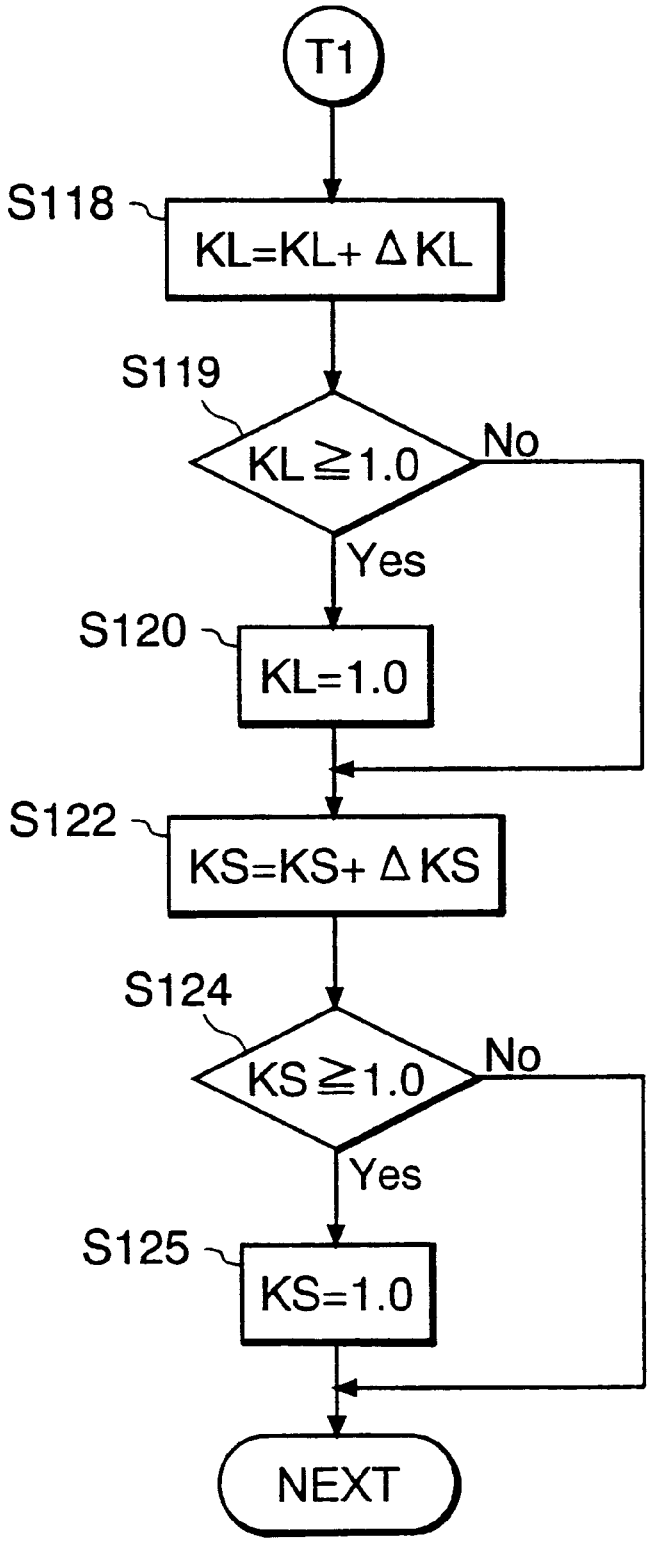
FIG. 13 is a flowchart showing the remaining part, continued from FIG. 12, of the timer routine.

Here, a procedure for counting various tailing coefficient values K1, K2, KL and KS in the timer routine will be described with reference to FIGS. 12 and 13.

In steps S110–S113 of the timer routine executed in response to the generation of a clock pulse in the ECU, the tailing coefficient value K1 is counted. First, a predetermined minute value ΔK1, which is smaller than 1.0 is added to the coefficient value K1 (step S110). This coefficient value K1 is compared with a value of 1.0 (step S112). If the coefficient value K1 is larger than the value 1.0, it is set to the value 1.0 (step S113). If the coefficient value K1 is equal to or smaller than the value of 1.0, the control procedure proceeds to step S114. That is, if the tailing coefficient value is once reset to a value of 0, the minute value ΔK1 is added to the coefficient value K1 each time the timer routine is executed. If the updated coefficient value K1 reaches the value of 1.0, it is kept at the value 1.0.

For the other tailing coefficient values, similar updating processing is carried out. That is, as for the tailing coefficient value K2, a predetermined minute value ΔK2 is added to the coefficient value K2 in steps S114–S117 until the K2 becomes a value of 1.0. As for the coefficients KL and LS, predetermined minute values ΔKL and ΔKS are added to the coefficient values KL and KS in steps S118–S120 and S122–S125, respectively.

The minute values, such as ΔK1, ΔK2, which are added to the respective coefficient values determine variation gradients (tailing speeds) of the combustion parameters and the like during the mode transition control, whereby a time period required for the mode transition control is determined. For example, with regard to the correction coefficient Kaf for the target A/F at the time of transition control from the second-term lean mode to the S-F/B mode, the predetermined minute value ΔK2 of the tailing coefficient value K2 determines a variation gradient θ2 of the correction coefficient Kaf (see FIG. 14).

The predetermined minute value ΔK1 of the tailing coefficient K1 is comprised of predetermined minute values ΔK1*a* and ΔK1*b*, as will be described in detail later.

Referring to FIG. 8 again, in step S51, a determination is made as to whether or not the dead time counter Td2 is counted down to the value 0, to thereby determine whether or not a dead time corresponding to the initial value f2(Ne, Pe) of the counter Td2 has elapsed. A counter value Td2, observed just when the step S51 is executed after the transition to the S-F/B mode is started, is equal to the initial value f2(Ne, Pe) for the counter Td2 set in step S21 in FIG. 5, as described above. Thus, just after the start of transition to the S-F/B mode, the result of determination in step S51 is No. In this case, the control flow proceeds to step S52, in which a predetermined value ΔTd2 is subtracted from the counter value Td2. In step S53, the tailing coefficient value K2 is set to the value 0 again. These steps S52, S53 are executed repeatedly until the aforementioned dead time has elapsed. During this time, the tailing coefficient value K2 is maintained at the value 0.

Next, in steps S55 and S57, the ECU 70 calculates a temporary target A/F correction coefficient value Kaft and a volumetric efficiency Ev in accordance with the following expressions (5) and (6), respectively:

$$Kaft=(1-K2)\cdot Kaf+K2\cdot Kaf \quad (5)$$

$$Ev=(1-K2)\cdot Ev'+K2\cdot Ev \quad (6)$$

where Kaf and Ev' respectively indicate a target A/F correction coefficient value and a volumetric efficiency obtained when step S21 was finally executed during the second-term lean mode control, and Kaf and Ev appearing in the last term of the right side of each expression respectively indicate a target A/F correction coefficient value and a volumetric efficiency, which are set in the current period of the S-F/B mode control.

In a time period (dead time starting from the time point t0 and ending at the time point t1 in FIG. 14), during which the coefficient value K2 is at a value of 0, the temporary target A/F correction coefficient Kaf and the volumetric efficiency Ev are respectively maintained at the value Kaf and Ev', which were set finally during the second-term lean mode control. After elapse of the dead time, the temporary target A/F correction coefficient Kaft and the volumetric efficiency Ev are set in accordance with expressions (5) and (6) by using, as a weight, the tailing coefficient K2, which increases from the value 0 to the value 1.0 with passage of time. More specifically, the calculated value Kaf of the target A/F correction coefficient for the S-F/B mode control is weighted by the coefficient value K2, and the final value Kaf of the target A/F correction coefficient for the second-term lean mode control is weighted by the value (1−K2). Further, the weighted final value Kaf and the weighted calculated value Kaf are summed up, to thereby obtain the temporary target A/F correction coefficient value Kaft. This is applied to the volumetric efficiency Ev.

When the tailing coefficient value K2 reaches the value 1.0, the temporary target A/F correction coefficient value Kaft and the volumetric efficiency Ev are set to the calculated values for the S-F/B mode.

As described above, the target A/F correction coefficient value Kaf and the volumetric efficiency Ev at the time of mode transition gradually change linearly (Kaf changes at the aforementioned variation gradient θ2) with the change in the tailing coefficient value K2 in a time period from the time point t1 to the time point t3. On and after the time point t3, they are maintained at values calculated for the S-F/B mode (FIG. 14 shows how the Kaf changes).

Figure 9:
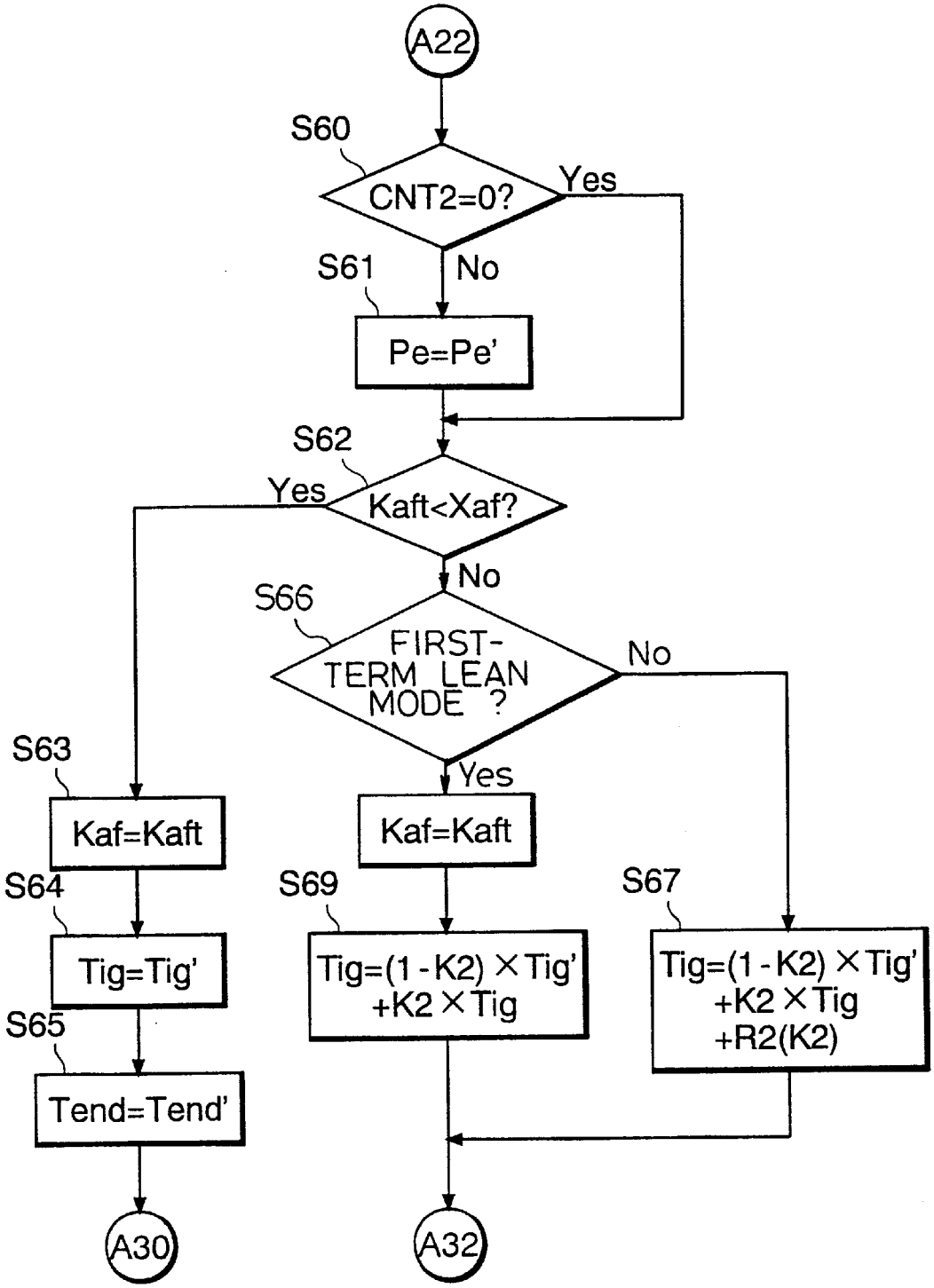
FIG. 9 is a flowchart showing a different part, continued from FIG. 8, of the combustion parameter setting routine.

Next, the control flow proceeds to step S60 in FIG. 9, in which whether or not the suction delay counter CNT2 is counted down to the value 0 is determined. If the result of this determination is No, i.e., if the suction delay counter CNT has not yet reached the value 0, the target average effective pressure Pe is set to the value Pe' in step S61, whereby the target average effective pressure, which was set finally during the second-term lean control is maintained over a predetermined period of time (corresponding to the initial value XN2 of the counter). The count value of the counter CNT2 is counted down in a crank interruption routine (not shown), which is executed each time a predetermined crank angle position of any one of the cylinders is detected.

Next, the control procedure proceeds to step S62, in which whether or not the temporary target A/F correction coefficient value Kaft calculated according to expression (5) is smaller than a discrimination value Xaf is determined. The discrimination value Xaf is set to such a value as to cause a rich misfire in the combustion chamber 5 of the engine if an engine control is conducted in the second-term lean mode with use of a target A/F correction coefficient value Kaf equal to the discrimination value Xaf. For example, the discrimination value Xaf is set to a value of about 20 in terms of entire air-fuel ratio (see FIG. 14). Thus, it is considered that the engine output can be adjusted by adjusting the fuel injection amount under the second-term lean mode, if the target A/F correction coefficient value Kaf is smaller than the discrimination value Xaf. In this case, the target A/F correction coefficient value Kaf is set to a value corresponding to the tailing coefficient K2, i.e., to the temporary target A/F correction coefficient value Kaft until this correction coefficient value Kaft reaches the discrimination value Xaf (until the time point t2 in FIG. 14) (step S63). In order to continue the control under the second-term lean mode, the ignition timing Tig is maintained at a final value Tig' set in the second-term lean mode (step S64), and the fuel injection termination timing Tend is maintained at a final value Tend' set in the second-term lean mode (step S65).

After the various combustion parameters are set again, as described above, step S22 in FIG. 5 described previously is executed, whereby the engine control is performed under the second-term lean mode.

On the other hand, if the tailing coefficient value K2 increases so that the temporary target A/F correction coefficient value Kaft exceeds the discrimination value Xaf, then the result of determination in step S62 in FIG. 9 becomes No. In this case, the control procedure proceeds to step S66 without executing the steps S63–S65.

In step S66, whether or not the injection mode is the first-term lean mode or the S-F/B mode is determined. Then, a control which varies depending on the result of this determination is performed. Here, the fuel injection mode after the transition is the S-F/B mode and hence the result of determination in step S66 is No. Thus, the control procedure proceeds to step S67 in which the ignition timing Tig is calculated in accordance with the following expression (7):

$$Tig=(1-K2)\cdot Tig'+K2\cdot Tig+R2(K2) \quad (7)$$

where R2(K2) is a retard amount for preventing a sudden change in engine output caused by a mode transition. The retard amount R2(K2) is set to a value which gradually decreases with the increase in the tailing coefficient value K2.

Figure 7:
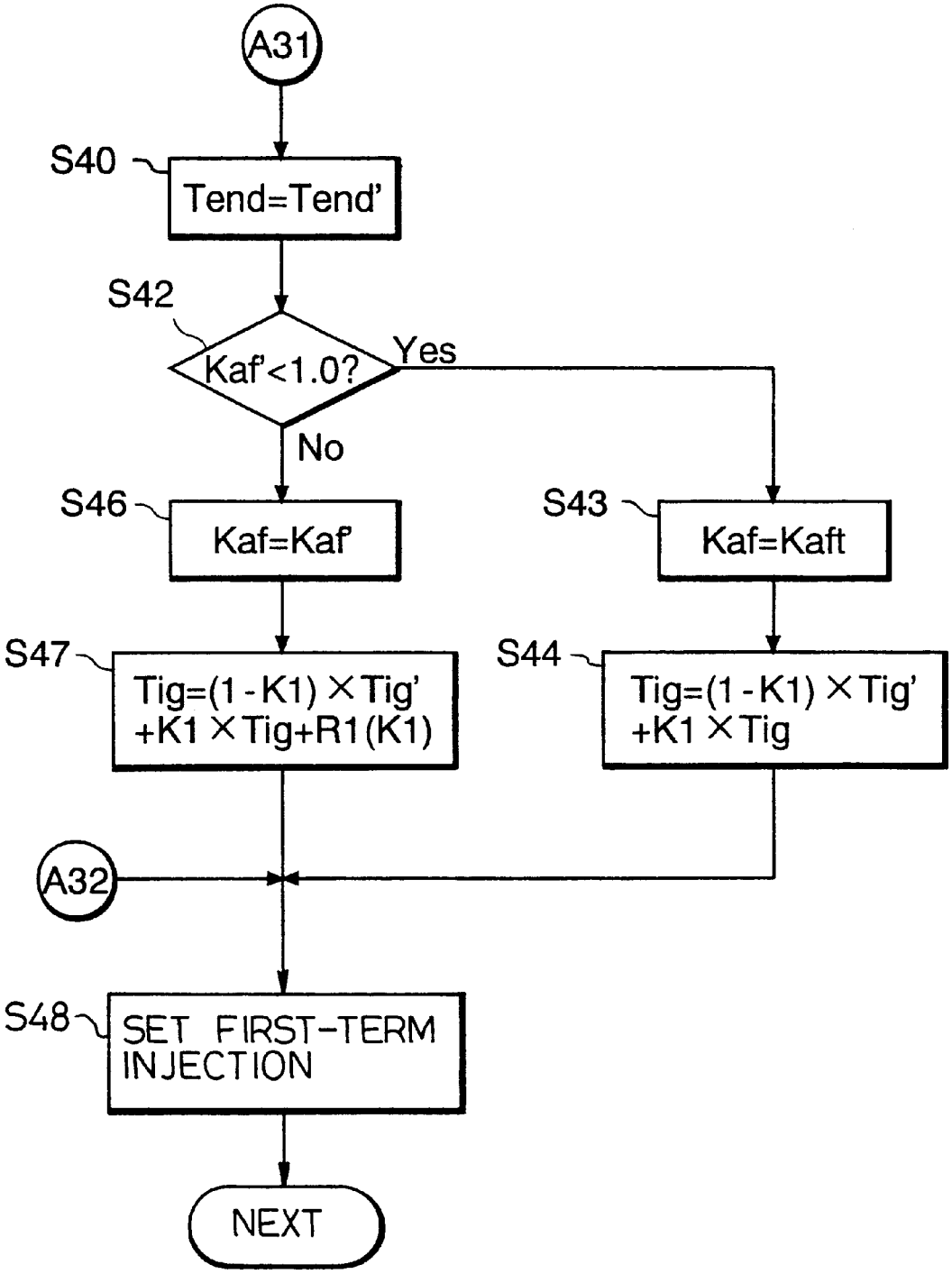
FIG. 7 is a flowchart showing a different part, continued from FIG. 6, of the combustion parameter setting routine.

After the various combustion parameters are set in the above manner, the control procedure proceeds to step S48 in FIG. 7 so that the engine control is performed under the first-term injection mode to which the S-F/B mode belongs.

Thereafter, if the tailing coefficient value K2 gradually increases and reaches a value of 1.0, the result of determination in step S50 in FIG. 8 becomes Yes. Thus, the control procedure proceeds to step S58, in which a determination is made as to whether the injection mode is the first-term lean mode or the S-F/B mode. If it is determined at step S58 that the injection mode is the S-F/B mode, the control flow proceeds to step S70 in FIG. 10, in which a preparation for transition to the second- or first-term lean mode control is made. More specifically, initial values of control variables are set, and the correction coefficient value Kaf and the combustion parameter values Ev, Tig, Tend, Legr, etc. calculated in the current combustion injection mode are stored. The control variables include a dead time and an EGR delay. In the dead time counter Td1, an initial value f1(Ne, Pe) is set in dependence on the target average effective pressure Pe and the engine rotation speed Ne. In the EGR delay counter, an initial value XN1 is set. These control variables are updated each time step S70 is conducted while the control under the S-F/B mode is periodically repeated.

After completion of execution of step S70, in which the initial values of the control variables and the like are set, the control flow proceeds to step S72, in which a determination is made as to whether or not the tailing coefficient value KL is at a value of 1.0, which coefficient value KL is used during the control of transition from the first-term lean mode to the S-F/B mode. At the present time point, the control is conducted in the S-F/B mode and hence the coefficient value KL is at a value of 1.0. Thus, the control flow proceeds to step S74, in which a count value in the EGR delay counter, described later, is determined. This counter CNT3 is reset to a value of 0 unless a transition control from the first-term lean mode to the S-F/B mode is carried out. If the control is made under the S-F/B mode, the result of determination in step S74 is Yes. In this case, the control flow proceeds to step S48, in which the control is made under the first-term injection mode to which the S-F/B mode belongs.

Next, a transition control from the S-F/B mode to the second-term lean mode will be described.

If the second-term lean mode is discriminated during the S-F/B mode control in step S1 shown in FIG. 4 (time point t4 in FIG. 14), the tailing coefficient K1 is set to a value of 0 in step S2. Then, various combustion parameter values and the like are obtained in step S12, as described above, and whether or not K1 is equal to the value 1.0 is determined in step S20 in FIG. 5. As described above, the tailing coefficient value K1 is at a value of 0 just after the second-term lean mode is discriminated. In this case, the result of determination in step S20 is No, and the control flow proceeds to step S24.

In step S24, whether or not the dead time counter Td1 is at a value of 0 is determined to thereby determine whether or not the dead time, corresponding to the initial value f1(Ne, Pe) of the counter Td1, has elapsed. Just after the transition to the second-term lean mode takes place, the counter value Td1 is equal to the initial value f1(Ne, Pe) of the counter Td1 set, at step S70 in FIG. 10, in the S-F/B mode control effected just before the transition. Thus, the result of determination in step S24 is No, and the control flow proceeds to step S25 In which a predetermined value ΔTd1 is subtracted from the counter value Td1. In step S26, the tailing coefficient value K1 is set to a value of 0. Steps S25 and S26 are repeatedly executed until the dead time has elapsed (during a time period from time point t4 to time point t5 in FIG. 14). During this time, the tailing coefficient is maintained at the value 0.

In step S28 and step S30 (FIG. 6), the ECU 70 calculates the temporary target A/F correction coefficient value Kaft and volumetric efficiency Ev in accordance with the following expressions (8) and (9).

$$Kaft=(1-K1)\cdot Kaf'+K1\cdot Kaf \quad (8)$$

$$Ev=(1-K1)\cdot Ev'+K1\cdot Ev \quad (9)$$

Figure 10:
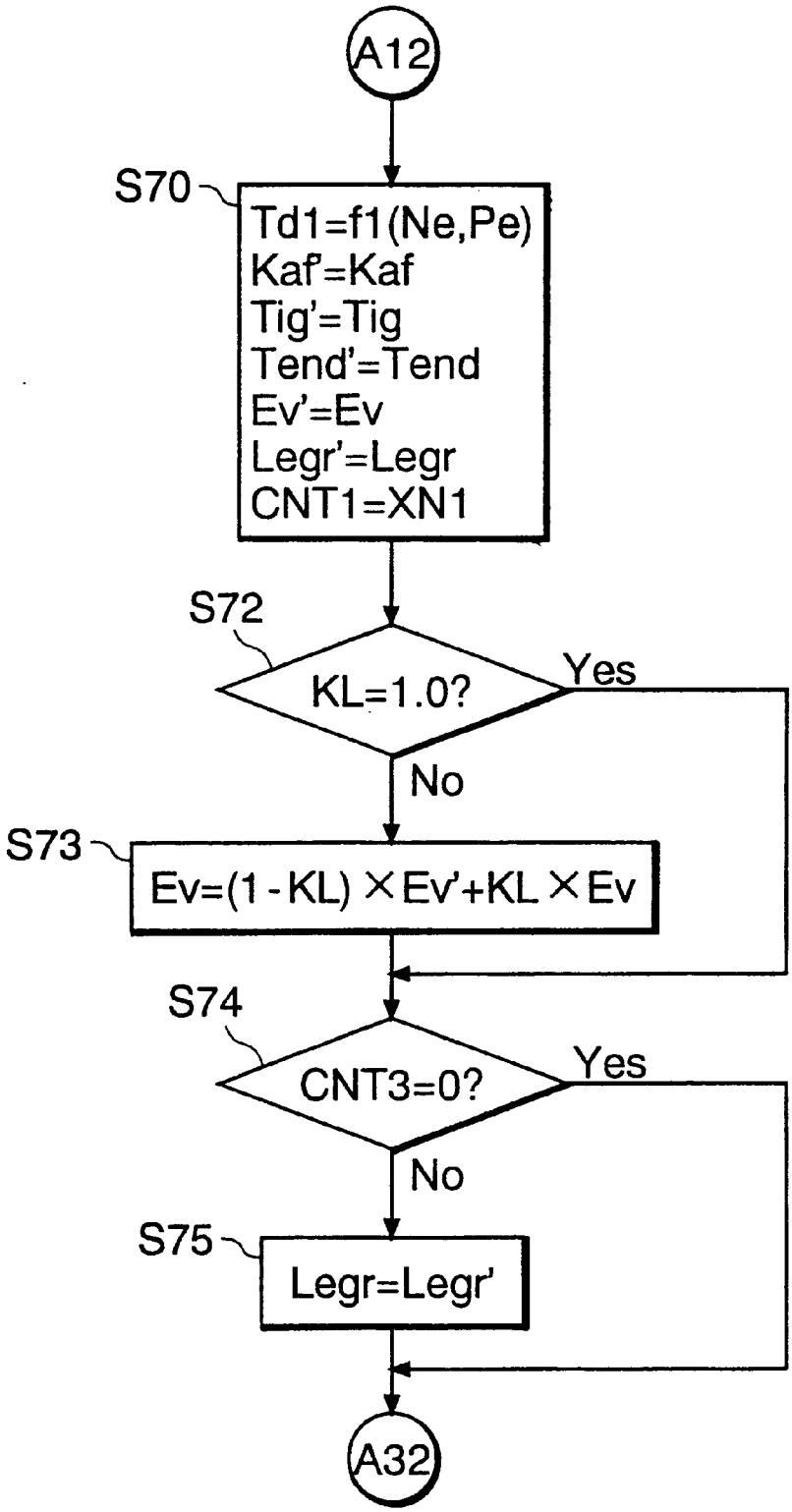
FIG. 10 is a flowchart showing a different part, continued from FIG. 8, of the combustion parameter setting routine.
Figure 11:
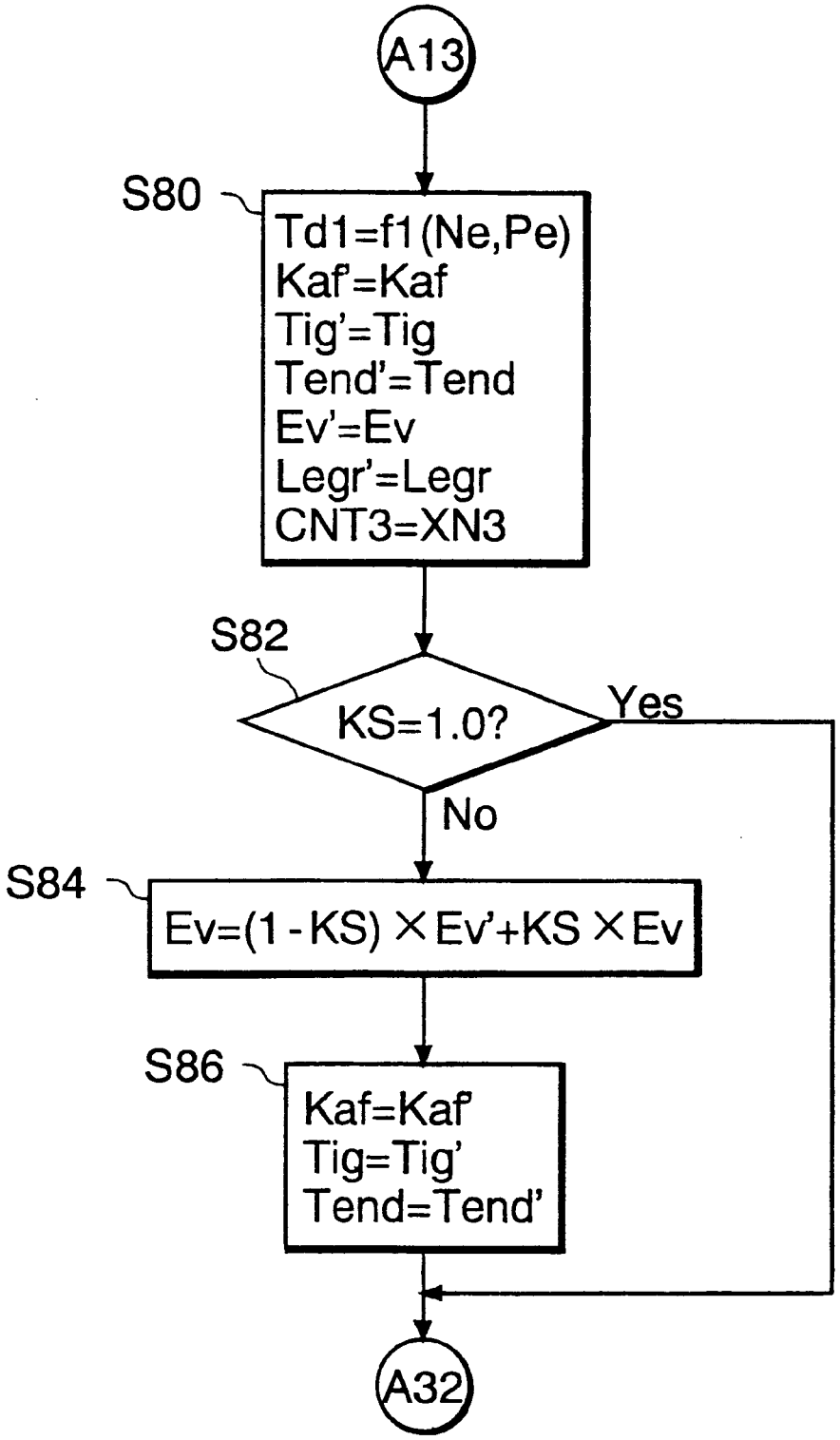
FIG. 11 is a flowchart showing the remaining part, continued from FIG. 8, of the combustion parameter setting routine.

In expressions (8) and (9) similar to expressions (5) and (6), Kaf' and Ev' respectively indicate the target A/F correction coefficient and the volumetric efficiency which were calculated when step S70 in FIG. 10 was finally executed in the S-F/B mode control, and Kaf and Ev appearing in the last term of the right side of the respective expressions indicate the correction coefficient and the volumetric efficiency calculated in the current period of the second-term lean mode.

During a time period (dead time from time point t4 to time point t5 in FIG. 14) in which the coefficient value K1 is at a value of 0, the temporary target A/F correction coefficient value Kaft and the volumetric efficiency Ev are respectively maintained at values of Kaf and Ev' finally set in the S-F/B mode control. After the dead time has elapsed, the temporary target A/F correction coefficient Kaft is obtained by summing up two values, which are respectively obtained by weighting the values Kaf' and Kaf with use of a coefficient value K1 (weight) which increases with passage of time (expression (8)). Likewise, the volumetric efficiency Ev utilized after elapse of the dead time is obtained by summing up weighted values Ev' and Ev obtained by using the coefficient value K1. If the coefficient value K1 reaches the value 1.0, the correction coefficient Kaft and the volumetric efficiency Ev are set individually to those values, which are calculated under the second-term lean mode. Consequently, the target A/F correction coefficient value Kaf and the volumetric efficiency Ev during the mode transition gradually change linearly with the aforementioned change in the tailing coefficient value K1. On and after the time point t7 in FIG. 14, these parameters Kaf and Ev are kept maintained at values calculated under the second-term lean mode, respectively.

Figure 6:
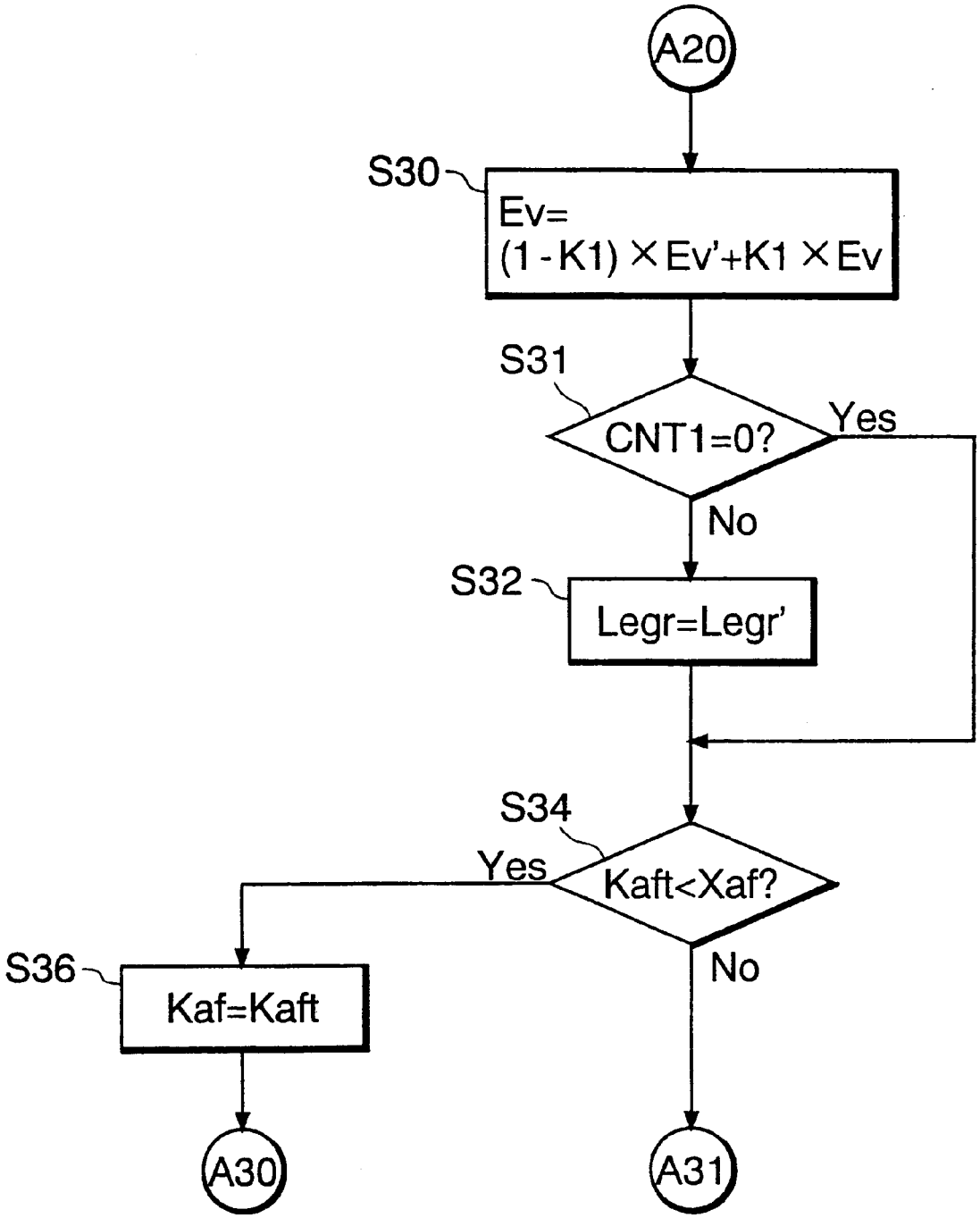
FIG. 6 is a flowchart showing a different part, continued from FIG. 5, of the combustion parameter setting routine.

Next, the control flow proceeds to step S31 in FIG. 6, in which whether or not the EGR delay counter CNT1 is counted down to the value 0 is determined. This counter CNT1 is provided with the intention of causing EGR control to be retarded in the second-term lean mode. By retarding EGR control, it is possible to prevent excessive exhaust gas recirculation during the transition control from the S-F/B mode to the second-term lean mode, in which a large amount of EGR is introduced. If it is determined in step S31 that the counter CNT1 has not been yet counted down to the value 0, the valve opening Legr of the EGR valve 45 is set, in step S32, to the value Legr' set finally at the time of S-F/B mode control. That is, the valve opening Legr' is kept unchanged for a predetermined time period (corresponding to the initial value XN1 of the counter, and starting at a time point t4 and ending at a time point t7 in FIG. 14).

If the setting of the valve opening in step S32 is completed or if the result of determination in step S31 is Yes, which indicates that the EGR delay interval has elapsed, the control flow proceeds to step S34.

In this step S34, a determination is made as to whether or not the temporary target A/F correction coefficient value Kaft calculated according to expression (8) is smaller than the discrimination value Xaf. This discrimination value Xaf may be equal to that used in step S62, but it is not essential to set both the discrimination values to the same value. If the result of determination in step S34 is Yes or if the target A/F correction coefficient value Kaf is smaller than the discrimination value Xaf, it is considered that the engine output is controllable under the second-term lean mode. In this case, the target A/F correction coefficient value Kaf is set, in step S36, to a temporary target A/F correction coefficient value Kaft (Kaf=Kaft). On the other hand, if the result of determination in step S34 is No or if the target A/F correction coefficient value Kaf is larger than the discrimination value Xaf, the S-F/B mode control is continued.

In a time period (from time point t5 to time point t6 in FIG. 14), in which the result of determination in step S34 is No or until the temporary target A/F correction coefficient value Kaft reaches the discrimination value Xaf, the control flow proceeds from step S34 to step S40 in FIG. 7, in which an injection termination period Tend is rewritten to and maintained at a calculated value Tend', which was finally calculated in the S-F/B mode. In order to discriminate whether the fuel injection mode established before the transition is determined is the first-term lean mode or the S-F/B mode, a determination is made in step S42 as to whether or not the correction coefficient value Kaf, set and stored just before the transition, is smaller than the value 1.0. Before executing the first-term lean mode control, the correction coefficient is always set to a value smaller than the value 1.0.

If the result of determination in step S42 is No, i.e., if the fuel injection mode prior to the transition is the S-F/B mode, the target A/F correction coefficient value Kaf is maintained, in step S46, at a value Kaf' obtained Just before the transition is determined. In step S47, the ignition timing Tig is calculated in accordance with the following expression (10):

$$Tig=(1-K1)\cdot Tig'+K1\cdot Tig+R1(K1) \quad (10)$$

where R1(K1) is a retard amount for preventing a sudden change in engine output caused by mode transition. The retard amount R1(K1) is set to a value which gradually increases as the tailing coefficient value K1 increases. Meanwhile, an initial-stage retard amount (first mode-changeover ignition timing) used just after the completion of the changeover from the second-term injection mode to the S-F/B mode may be set to the same value as a final-stage retard amount (second mode-changeover ignition timing) used just before the start of changeover from the S-F/B mode to the second-term injection mode. Alternatively, these two retard amounts and their changing speeds can be set independently from each other in accordance with the engine operating state.

After various combustion parameter values are set in the above manner, step S48 is executed so that engine control is carried out in the first-term injection mode.

If the tailing coefficient value K1 increases so that the temporary target A/F correction coefficient value Kaft becomes smaller than the discrimination value Xaf, the result of determination in step S34 in FIG. 6 becomes Yes. In this case, the control flow proceeds to step S36, in which the target A/F correction coefficient value Kaf is set to the temporary target A/F correction coefficient value Kaft (Kaf=Kaft). As for the fuel injection termination period Tend and the ignition timing Tig, those values, which are calculated in the second-term lean mode, are utilized.

After various combustion parameter values are set in the above manner, step S22 in FIG. 5 is executed so that the engine control is carried out in the second-term lean mode.

If the tailing coefficient value K1 gradually increases to reach the value 1.0, it is considered that the transition to the second-term lean mode has been completed. On and after the present time point, the result of determination in step S20 in FIG. 5 is Yes. In this case, a preparation for a transition to the first-term injection mode is carried out in step S21, and the engine control in the second-term lean mode is continued in step S22.

Referring to FIG. 14, at the time of transition control from the S-F/B mode to the second-term lean mode, if the temporary target A/F correction coefficient value Kaft exceeds the discrimination value Xaf (in a period of time from time point t5 to time point t6 in FIG. 14), the target A/F correction coefficient value Kaf gradually decreases at a variation gradient (first variation speed) $\theta 1a$. If the temporary target A/F correction coefficient value Kaft becomes smaller than the discrimination value Xaf (in a time period from time point t6 to time point t7), the target A/F correction coefficient value Kaf gradually decreasingly changes at a variation gradient $\theta 1b$ (second variation speed) which is smaller than the variation gradient $\theta 1a$ ($\theta 1b<\theta 1a$). That is, when the temporary target A/F correction coefficient value Kaft is smaller than the discrimination value Xaf, the tailing speed (variation speed) of the target A/F correction coefficient value Kaf is decreased as compared with a case where the temporary target A/F correction coefficient value Kaft is larger than the discrimination value Xaf.

More specifically, in case that the temporary target A/F correction coefficient value Kaft exceeds the discrimination value Xaf, a predetermined minute value $\Delta K1a$ is used as a predetermined minute value $\Delta K1$, by which the tailing coefficient K1 is determined. On the other hand, when the temporary target A/F correction coefficient value Kaft becomes smaller than the discrimination value Xaf, a predetermined minute value $\Delta K1b$ ($\Delta K1b<\Delta K1a$) which is smaller than the predetermined minute value $\Delta K1a$ is used as the predetermined minute value $\Delta K1$.

When a transition control from the first-term injection mode to the second-term injection mode is carried out, a control of opening and closing the #1ABV 24 and #2ABV 27 (intake air amount adjusting means) is usually made to thereby control the intake air amount Qa. As a result, a decrease in output torque of the engine 1 at the time of mode transition is compensated. Therefore, at the time of transition control, it is desirable to set a fuel injection time Tinj or a fuel injection amount to follow the intake air amount Qa. That is, it is desirable to allow the target A/F correction coefficient value Kaf to change depending on a change in the intake air amount Qa.

However, if the target A/F correction coefficient Kaf is set depending on a change in the intake air amount Qa, a complicated control is required, and therefore, this is not practical.

In view of the above situation, by making a changeover of the predetermined minute value ΔK1 of the tailing coefficient K1 as described above, the tailing speed of the target A/F correction coefficient value Kaf, used when the temporary target A/F correction coefficient value Kaft is below the discrimination value Xaf so that the engine is in the second-term lean mode range, is set to be smaller than that used when the temporary target A/F correction coefficient value Kaft exceeds the discrimination value Xaf so that the engine is in the S-F/B mode range. By doing this, the target A/F correction coefficient value Kaf is made one which easily and adequately follows a change in the intake air amount Qa. Moreover, just before completion of the transition control from the S-F/B mode to the second-term lean mode, the tailing speed of the target A/F correction coefficient value Kaf is adjusted to a very mild speed.

In case that a vehicle is traveling at a low speed so that the engine 1 is in a low load region, the fuel injection mode is usually changed from the S-F/B mode to the second-term lean mode. At this time, the output torque of the engine 1 is likely to drop largely. However, by changing the fuel injection amount in a manner following the intake air amount Qa, a change in the output torque can be suppressed, thereby reducing a so-called torque shock.

Meanwhile, the predetermined minute value ΔK1 of the tailing coefficient K1, that is, each of the predetermined minute values ΔK1*a* and ΔK1*b*, has a correlation with the target average effective pressure Pe. Thus, a further excellent transition control can be realized by setting these predetermined minute values ΔK1*a* and ΔK1*b* appropriately depending on the target average effective pressure Pe.

With regard to the transition control from the S-F/B mode (intake-stroke injection mode) to the second-term lean mode (compression-stroke injection mode), the variation gradient of the target A/F correction coefficient value Kaf, i.e., the tailing speed, used when the temporary target A/F correction coefficient value Kaft decreases beyond the discrimination value Xaf, is adjusted to be lower than the tailing speed then used. The tailing speed used at the time of the below-mentioned transition from the first-term lean mode to the second-term lean mode and the tailing speed used at the time of transition from the second-term lean mode to the S-F/B mode or to the first-term lean mode may be also varied. Meanwhile, at the time of transition from the second-term lean mode to the S-F/B mode or to the first-term lean mode, the operation range of the engine 1 usually changes from a low load range to a medium or high load range. In this case, the intake air amount Qa is likely to continue to increase, and hence an adjustment of decreasing the tailing speed is not effective.

In the following, explanations will be given as to transition controls from the second-term lean mode to the first-term lean mode, from the first-term lean mode to the second-term lean mode, from the first-term lean mode to the S-F/B mode, and from the S-F/B mode to the first-term lean mode. These transition controls are similar to the transition control from the second-term lean mode to the S-F/B mode. Thus, detailed explanations of the transition controls are omitted herein, and a combustion parameter setting routine (FIGS. 4–13) for the transition controls will be described in respect of points different from the foregoing description.

In the transition control from the second-term lean mode to the first-term lean mode, the control flow proceeds from step S1 in FIG. 4 through steps S5, S6, S14, and step S50 in FIG. 8 to step S51 in which whether or not the dead time Td2 has elapsed is determined. If the result of determination in step S51 becomes Yes with the progress of the transition control to the first-term lean mode, the control flow proceeds to step S66 through steps S55, S57, and steps S60, S61, S62 in FIG. 9. If it is determined in step S66 that the injection mode is the first-term lean mode, the target A/F correction coefficient value Kaf is rewritten in step S68 to the temporary target A/F correction coefficient value Kaft. In step S69, the ignition timing Tig is calculated in accordance with the following expression (11):

$$Tig=(1-K2)\cdot Tig'+K2\cdot Tig \tag{11}$$

As seen from expression (11), a retard amount R2(K2) is not used for the calculation of the ignition timing Tig in the transition control to the first-term lean mode, unlike the case (expression (10)) where the transition control to the S-F/B mode is performed.

In the transition control to the first-term lean mode, as for the injection termination period Tend, the calculated value in the first-term lean mode is used as it is.

When the K2 value reaches the value 1.0 with a further progress of the transition control to the first-term lean mode, the ignition timing Tig is shifted to the calculated value in the first-term lean mode, as seen from the expression (11). In this case, the result of determination in step S50 becomes Yes and the control flow proceeds to step S58. If it is determined in step S58 that the fuel injection mode is the first-term lean mode, the control flow proceeds to step S80 in FIG. 11.

In this step S80, a preparation for transition control to the second-term lean mode or to the S-F/B mode is carried out. That is, initial values of control variables are set, and a correction coefficient value Kaf and combustion parameters Ev, Tig, Tend, Legr and the like calculated in the current injection mode are stored. The control variables include dead time and EGR delay. In the dead time counter Td1, the initial value f1(Ne, Pe) is set depending on the target average effective pressure Pe and the engine rotation speed Ne. The initial value XN3 is set in the EGR delay counter CNT3. These control variables are updated each time the step S80 is executed while the control in the S-F/B mode is periodically carried out.

After completion of the setting of the initial values such as the control variables in step S80, the control flow proceeds to step S82, in which whether or not the tailing coefficient KS for use in the transition control from the S-F/B mode to the first-term lean mode is at a value of 1.0 is determined. Here, the control in the first-term lean mode is carried out, and hence the coefficient value is at a value of 1.0. The control flow proceeds to step S48 in FIG. 7, skipping steps S84 and S86, whereby the control in the first-term injection mode is carried out.

Next, the transition control from the first-term lean mode to the second-term lean mode will be described. During the transition control from the first-term lean mode, the control flow proceeds from step S1 in FIG. 4 to step S42 in FIG. 7 through, e.g., steps S2, S12; steps S20, S24, S28 in FIG. 5; steps S30, S31, S32, S34 in FIG. 6; and step S40 in FIG. 7.

If the result of determination in step S42 in FIG. 7 is Yes or if the injection mode is determined to be the first-term lean mode, the target A/F correction coefficient value Kaf is rewritten to the temporary target A/F correction coefficient value Kaft in step S43. In step S44, the ignition timing Tig is calculated depending on the tailing coefficient in accordance with the following expression (12):

$$Tig=(1-K1)\cdot Tig'+K1\cdot Tig \quad (12)$$

At the time of transition from the S-F/B mode to the second-term lean mode, the retard amount R1(K1) is used to prevent a sudden change in the engine output caused by the transition. However, the retard amount R1(K1) is not included in expression (12). That is, in the case of transition from the first-term lean mode to the second-term lean mode, the engine output is controlled by adjusting the air-fuel ratio. Therefore, a correction by means of the retard amount R1(K1) is not necessary, so that the ignition timing Tig is set in dependence on the tailing coefficient value K1.

Next, a transition control from the first-term lean mode to the S-F/B mode will be described. In this transition control, the control flow proceeds from step S1 in FIG. 4 to step S72 in FIG. 10 through steps S5, S7, S8, S14; steps S50, S51, S55, S58 in FIG. 8; and step S70 in FIG. 10. Just after a transition to the S-F/B mode is determined, the tailing coefficient value KL has been set to the value 0, and therefore, the result of determination in step S72 is No. In this case, the volumetric efficiency Ev is calculated in step S73 in accordance with the following expression:

$$Ev=(1-KL)\cdot Ev'+KL\cdot Ev \quad (13)$$

In expression (13) similar to expression (6), Ev' indicates the volumetric efficiency calculated finally in the first-term lean mode, and Ev appearing at the last term of the right side is a value calculated in the current period of the S-F/B mode.

When the coefficient value KL lies between the value 0 and the value 1, the volumetric efficiency Ev is set to a sum of the calculated values Ev' and Ev weighted by the coefficient value KL each. If the coefficient value KL reaches the value 1.0, the value Ev is set to a calculated value in the S-F/B mode.

If the result of determination in step S74 is No or if an EGR delay period has not elapsed, the valve opening Legr of the EGR valve 45 is set to the preceding value, i.e., the value Legr' obtained at the time of the first-term lean mode control conducted just before the transition to the S-F/B mode was determined.

Finally, the transition control from the S-F/B mode to the first-term lean mode will be described. In this transition control, the control flow proceeds from step S1 in FIG. 4 to step S82 in FIG. 11 through steps S5, S6, S14; steps S50, S58 in FIG. 8; and step S80. Just after the transition to the first-term lean mode is determined, the tailing coefficient value KS has been set to the value 0, and therefore, the result of determination in step S82 is No. In this case, steps S84 and S86 are repeatedly executed. In step S84, the volumetric efficiency Ev is calculated in accordance with the following expression (14):

$$Ev=(1-KS)\cdot Ev'+KS\cdot Ev \quad (14)$$

In expression (11) similar to expressions (13) and (6), Ev' indicates the volumetric efficiency finally calculated in the S-F/B mode, and Ev appearing at the last term of the right side is a calculated value in the first-term lean mode.

In the next step S86, the target A/F correction coefficient value Kaf, the ignition timing Tig and the injection termination period Tend are set to finally calculated values Kaf, Tig' and Tend' in the S-F/B mode, respectively. These values are maintained until the tailing coefficient value KS becomes a value of 1.0.

As described above in detail, in order to determine the fuel injection amount in the second-term injection mode, the control apparatus of the instant embodiment calculates the fuel injection timing Tinj in accordance with the target A/F which is determined on the basis of the throttle opening θth (see the Pe calculating section 80 and the target A/F calculating section 90 in FIG. 2), instead of setting the fuel injection amount directly using the throttle opening information θth from the TPS 29.

Thus, the target A/F can be controlled appropriately regardless of the fuel injection mode. As a result, a very excellent and appropriate combustion control can be realized.

In the calculation of the fuel injection timing Tinj for the second-term injection mode, the control apparatus of the instant embodiment calculates the intake air amount Qa on the basis of the unit intake air amount A/N(n) detected in the present control period, in view of the fact that the suction of intake air is completed before the start of fuel injection. In other words, a correction of the intake air is prohibited in the second-term injection mode to thereby determine the fuel injection timing Tinj accurately, even though such an intake air correction is made in the first-term injection mode as in a conventional intake-pipe-injection type internal combustion engine.

A proper operating state of the engine 1 can be always maintained regardless of the fuel injection mode, by effecting the correction of intake air in the first-term injection mode and prohibiting the correction in the second-term injection mode.

During the transition control from the S-F/B mode (intake-stroke injection mode) to the second-term lean mode (compression-stroke injection mode), the control apparatus of the instant embodiment causes the target A/F correction coefficient value Kaf to change at the variation gradient (first variation speed) θ1*a*, if the target A/F correction coefficient value Kaf exceeds the discrimination value Xaf (in a time period between t5 and t6 in FIG. 14), and causes the target A/F correction coefficient value Kaf to change at a variation gradient (second variation speed) θ1*b* smaller than the variation gradient θ1*a* (θ1*b*<θ1*a*), if the target A/F correction coefficient value Kaf is less than the discrimination value Kaf (in a time period between t6 and t7 in FIG. 14). As a result, the tailing speed of the target A/F correction coefficient value Kaf is lowered when the transition control reaches its end.

Therefore, just before the completion of the transition control from the S-F/B mode to the second-term lean mode, the target A/F correction coefficient value Kaf can smoothly approach the target A/F correction coefficient value Kaf used in the second-term lean mode.

When a vehicle runs at a low speed so that the engine 1 is in a low load range, the fuel injection mode is usually switched from the S-F/B mode to the second-term lean mode. At the time of such a mode transition, the output torque of the engine 1 tends to drop, and hence a control is made to increase or decrease the intake air amount Qa. According to the instant embodiment, the variation gradient of the target A/F correction coefficient value Kaf is controlled as described above, to thereby make the fuel injection amount substantially follow a change in the intake air amount Qa, without making the control procedure complicated. At the time of transition from the S-F/B mode to the second-term lean mode (and from the first-term lean mode to the second-term lean mode), therefore, a change in the output torque of the engine 1 can be suppressed, thereby reducing a so-called torque shock appropriately.

The present invention is not limited to the foregoing embodiments, but may be modified in various manners.

For example, the present invention is applicable to a drive-by wire (hereinafter referred to as DBW) engine, which has an accelerator position sensor (hereinafter referred to as APS) thereof disposed around the accelerator pedal and which is adapted to control the opening degree of an electric throttle valve provided in the throttle body in accordance with an accelerator pedal voltage VAC supplied from the APS and indicative of an accelerator pedal depressing amount θAC, unlike the embodiments having the second air bypass pipe 26 which is disposed bypassing the throttle body 23 and which is subject to open/close control by the second air-bypass valve 27. In this case, the APS functions as an accelerating state detecting means for detecting the operation state of the accelerator pedal serving as an accelerator member.

In such a DBW type engine, at the time of engine operation in the second-term injection mode, the second-term injection lean mode or the like, it is possible to correct the intake air amount to increase, as in the case of the second air bypass valve 27 of the above embodiment, by setting the throttle opening degree to one which is larger than a standard opening degree corresponding to the accelerator pedal depressing amount.

What is claimed is:

1. A control apparatus for a cylinder-injection internal combustion engine having a combustion chamber, a fuel injection device for supplying fuel directly into the combustion chamber, and an accelerator member for engine speed adjustment, comprising:

acceleration state detecting means for detecting an operation state of the accelerator member and generating an output indicative of the detected operation state of the accelerator member;

intake air amount detecting means for detecting an intake air amount sucked into the combustion chamber and generating an output indicative of the detected intake air amount;

first load-related value calculating means for calculating a first load-related value in accordance with the output of said acceleration state detecting means;

second load-related value calculating means for calculating a second load-related value in accordance with the output of said intake air amount detecting means;

injection mode selecting means for selecting either a compression-stroke injection mode where fuel injection is performed mainly in a compression stroke or an intake-stroke injection mode where fuel injection is performed mainly in an intake stroke, in accordance with either the first or second load-related value;

target air-fuel ratio calculating means for calculating a target air-fuel ratio based on each of the first and second load-related values;

a fuel injection amount calculating means for calculating fuel injection amount in accordance with the target air-fuel ratio calculated based on the first load-related value by said target air-fuel calculating means and the intake air amount detected by said intake air amount detecting means when the compression-stroke injection mode is selected by said injection mode selecting means, and for calculating a fuel injection amount in accordance with the target air-fuel ratio calculated based on the second load-related value by said target air-fuel ratio calculating means and the intake air amount detected by said intake air amount detecting means when the intake-stroke injection mode is selected; and fuel injection control means for controlling the fuel injection device in accordance with the fuel injection amount calculated by said fuel injection amount calculating means.

2. The control apparatus according to claim 1, further comprising:

intake air amount correcting means for correcting the intake air amount detected by said intake air amount detecting means when the intake-stroke injection mode is selected by said injection mode selecting means.

3. The control apparatus according to claim 2, wherein said fuel injection amount calculating means calculates the fuel injection amount in accordance with a corrected intake air amount obtained by correcting the intake air amount, detected by said intake air amount detecting means, by said intake air amount correcting means.

4. The control apparatus according to claim 2, further comprising:

engine rotation speed detecting means for detecting an engine rotation speed, wherein said intake air amount correcting means includes a unit intake air amount calculating means for calculating a unit intake air amount, indicative of an intake air amount per unit intake stroke, in accordance with the intake air amount detected by said intake air amount detecting means and the engine rotation speed detected by said engine rotation speed detecting means, and wherein said intake air amount correcting means corrects the intake air amount detected by said intake air amount detecting means in accordance with said unit intake air amount calculated by said unit intake air amount calculating means.

5. The control apparatus according to claim 4, wherein said unit intake air amount calculating means periodically calculates the unit intake air amount, and wherein said intake air amount correcting means corrects the intake air amount, detected by said intake air amount detecting means, in accordance with a current unit intake air amount, calculated by said unit intake air amount calculating means in a current calculation period with respect to a certain cylinder of the internal combustion engine, and a difference between the current unit intake air amount and a preceding unit intake air amount calculated by said unit intake air amount calculating means in a preceding calculation period with respect to another cylinder of the internal combustion engine.

6. The control apparatus according to claim 1, wherein said target air-fuel ratio calculating means sets the target air-fuel ratio to a first air-fuel ratio which is leaner than a stoichiometric air-fuel ratio when the compression-stroke injection mode is selected by said injection mode selecting means; and wherein said target air-fuel ratio calculating means sets the target air-fuel ratio to a second air-fuel ratio which is richer than the first air-fuel ratio when the intake-stroke injection mode is selected.

7. The control apparatus according to claim 6, further comprising:

an air-fuel ratio transition means for variably setting a transitional target air-fuel ratio when an injection mode, different from an injection mode then selected, is newly selected by said injection mode selecting means so that an injection mode changeover is commenced;

wherein said air-fuel ratio transition means sets a mode-changeover air-fuel ratio which falls within a range defined by a target air-fuel ratio in the injection mode before the changeover and a target air-fuel ratio in the injection mode after the changeover, and gradually changes the transitional target air-fuel ratio at a first change speed from the target air-fuel ratio in the injection mode before the changeover to the mode-changeover air-fuel ratio, while maintaining a fuel injection timing suitable for the injection mode before the changeover, and wherein said air-fuel ratio transition means changes the fuel injection timing suitable for the injection mode before the changeover to a fuel injection timing suitable for the injection mode after the changeover when the transitional target air-fuel ratio reaches the mode-changeover air-fuel ratio, and then gradually changes the target air-fuel ratio at a second change speed from the mode-changeover air-fuel ratio or an air-fuel ratio in the vicinity thereof to the target air-fuel ratio in the injection mode after the changeover.

8. The control apparatus according to claim 7, wherein said air-fuel ratio transition means sets the second change speed to a value smaller than the first change speed.

9. The control apparatus according to claim 7, wherein said air-fuel ratio transition means sets the second change speed to a value smaller than the first change speed, when a changeover is made from the intake-stroke injection mode to the compression-stroke injection mode.

10. The control apparatus according to claim 7, wherein said air-fuel ratio transition means sets the first and second change speeds in accordance with the first load-related value.

11. The control apparatus according to claim 7, wherein said air-fuel ratio transition means sets the first and second change speeds in dependence on a quantity of intake air amount adjustment which is effected by an intake air amount adjusting means provided in the internal combustion engine for adjusting the intake air amount in accordance with the output from said acceleration state detecting means.

12. A control apparatus for a cylinder-injection internal combustion engine having a combustion chamber and a fuel injection device for supplying fuel directly to the combustion chamber, comprising:

operating state detecting means for detecting an operating state of the internal combustion engine;

injection mode selecting means for selecting either a compression-stroke injection mode where fuel injection is performed mainly in a compression stroke or an intake-stroke injection mode where fuel injection is performed mainly in an intake stroke, in accordance with the operating state of the internal combustion engine detected by said operating state detecting means;

combustion parameter setting means for setting a value of a combustion parameter, affecting a combustion state in the combustion chamber, in dependence on the injection mode selected by said injection mode selecting means;

combustion control means for controlling the combustion state in accordance with the combustion parameter value set by said combustion parameter setting means and corresponding to the selected injection mode; and combustion parameter transition means for changing a combustion parameter value before the changeover, suitable for the injection mode before the changeover, to a combustion parameter value after the changeover, suitable for the injection mode after the changeover, when an injection mode, different from an injection mode then selected, is newly selected by said injection mode selecting means so that an injection mode changeover is commenced, wherein said combustion parameter includes a target air-fuel ratio, wherein said combustion parameter transition means includes an air-fuel ratio transition means for variably setting a transitional target air-fuel ratio when the injection mode changeover is performed, wherein said air-fuel ratio transition means sets a mode-changeover air-fuel ratio which falls within a range defined by a target air-fuel ratio in the injection mode before the changeover and a target air-fuel ratio in the injection mode after the changeover, and gradually changes the transitional target air-fuel ratio at a first change speed from the target air-fuel ratio in the injection mode before the changeover to the mode-changeover air-fuel ratio, while maintaining a fuel injection timing suitable for the injection mode before the changeover, and wherein said air-fuel ratio transition means changes the fuel injection timing suitable for the injection mode before the changeover to a fuel injection timing suitable for the injection mode after the changeover when the target air-fuel ratio reaches the mode-changeover air-fuel ratio, and then gradually changes the transitional target air-fuel ratio at a second change speed from the mode-changeover air-fuel ratio or an air-fuel ratio in the vicinity thereof to a target air-fuel ratio in the injection mode after the changeover.

13. The control apparatus according to claim 12, wherein said air-fuel ratio transition means sets the second change speed to a value smaller than the first change speed.

14. The control apparatus according to claim 12, wherein said air-fuel ratio transition means sets the second change speed to a value smaller than the first change speed, when a changeover is made from the intake-stroke injection mode to the compression-stroke injection mode.

15. The control apparatus according to claim 12, further comprising:

first load-related value calculating means for calculating a first load-related value, wherein said operating state detecting means includes an acceleration state detecting means for detecting an operation state of an accelerator member provided in the internal combustion engine for engine speed adjustment, and for generating an output indicative of the detected operation state of the accelerator member, wherein said first load-related value calculating means calculates the first load-related value in accordance with the output of said acceleration state detecting means, and wherein said air-fuel ratio transition means sets the first and second change speeds in accordance with the first load-related value calculated by said first load-related value calculating means.

16. The control apparatus according to claim 12, wherein said air-fuel ratio transition means sets the first and second change speeds in dependence on a quantity of intake air amount adjustment which is effected by an intake air amount adjusting means provided in the internal combustion engine for adjusting the intake air amount in accordance with the output from said acceleration state detecting means.

17. The control apparatus according to claim 12, further comprising:

intake air amount detecting means for detecting an intake air amount sucked into the combustion chamber, wherein said air-fuel ratio transition means sets the first and second change speeds so as to be proportional to a quantity of change in the intake air amount detected by said intake air amount detecting means.

18. The control apparatus according to claim 12, wherein said combustion parameter includes an ignition timing at which fuel supplied from the fuel injection device to the combustion chamber is spark-ignited by ignition means provided in the internal combustion engine, wherein said combustion parameter transition means includes an ignition timing transition means for controlling a transitional ignition timing, serving as the ignition timing during injection mode transition, so as to allow the output of the internal combustion engine to change smoothly, when the injection mode transition is made.

19. The control apparatus according to claim 18, wherein said ignition timing transition means holds the transitional ignition timing at an ignition timing suitable for the compression-stroke injection mode when injection mode transition from the compression-stroke injection mode to the intake-stroke injection mode is determined by said injection mode selecting means, wherein said ignition timing transition means temporarily sets the transitional ignition timing at a first mode-changeover ignition timing retarded by a predetermined amount from an ignition timing suitable for the intake-stroke injection mode, when the target air-fuel ratio reaches the mode-changeover air-fuel ratio, and gradually advances the transitional ignition timing from the first mode-changeover ignition timing to an ignition timing suitable for the intake-stroke injection mode, as the target air-fuel ratio is changed by said air-fuel ratio transition means.

20. The control apparatus according to claim 18 wherein said ignition timing transition means sets a second mode-changeover ignition timing retarded by a predetermined amount form an ignition timing suitable for the intake-stroke injection mode when injection mode transition from the intake-stroke injection mode to the compression-stroke injection mode is determined by said injection mode selecting means, and then gradually advances the transitional ignition timing from the ignition timing suitable for the intake-stroke injection mode to the second mode-changeover ignition timing, as the target air-fuel ratio is changed by said air-fuel ratio transition means, and wherein said ignition timing transition means immediately changes the transitional ignition timing to an ignition timing suitable for the compression-stroke injection mode when the target air-fuel ratio reaches the mode-changeover air-fuel ratio.

* * * * *